US006237356B1

(12) United States Patent
Hori et al.

(10) Patent No.: US 6,237,356 B1
(45) Date of Patent: May 29, 2001

(54) REFRIGERATING PLANT

(75) Inventors: Yasushi Hori; Shinri Sada, both of Osaka (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 09/381,739

(22) PCT Filed: Jan. 29, 1999

(86) PCT No.: PCT/JP99/00368

§ 371 Date: Sep. 23, 1999

§ 102(e) Date: Sep. 23, 1999

(87) PCT Pub. No.: WO99/39138

PCT Pub. Date: Aug. 5, 1999

(30) Foreign Application Priority Data

Jan. 30, 1998 (JP) ..... 10-018464
Sep. 16, 1998 (JP) ..... 10-261183

(51) Int. Cl.[7] ..... F25B 13/00

(52) U.S. Cl. ..... 62/324.1; 62/238.4; 62/501; 62/335

(58) Field of Search ..... 62/324.1, 238.4, 62/501, 335

(56) References Cited

U.S. PATENT DOCUMENTS 3,240,028 * 3/1966 Redfren et al. ..... 62/324.1
4,228,661 * 10/1980 Vinz ..... 62/89
4,912,937 * 4/1990 Nakamura et al. ..... 62/160
5,129,236 * 7/1992 Solomon ..... 62/324.1
5,526,649 * 6/1996 Sada ..... 62/175
5,761,921 * 6/1998 Hori et al. ..... 62/238.4
6,050,102 * 4/2000 Jin ..... 62/324.6

FOREIGN PATENT DOCUMENTS 62-238951 10/1987 (JP) .
5-141793 6/1993 (JP) .
6-82110 3/1994 (JP) .

* cited by examiner

*Primary Examiner*—William Doerrler
*Assistant Examiner*—Mark Shulman
(74) *Attorney, Agent, or Firm*—Nixon Peabody, LLP; Donald R. Studebaker

(57) ABSTRACT

A compressor (2), a heat releasing element (3A) of a heat exchanger (3) for heating, an electromotive expansion valve (4), and a heat absorbing element (5A) of a heat exchanger (5) for cooling are connected to each other to constitute a primary refrigerant circuit. A pump (11), a heat absorbing element (3B) of the heat exchanger (3) for heating, a first indoor heat exchanger (12), an electromotive expansion valve (13), a second indoor heat exchanger (14), and a heat releasing element (5B) of the heat exchanger (5) for cooling are connected to each other to compose a secondary refrigerant circuit (10). A liquid refrigerant ejected from the pump (11) is evaporated in the heat absorbing element (3B) of the heat exchanger (3) for heating, reduced in pressure by the electromotive expansion valve (13), and evaporated in the second indoor heat exchanger (14). Thereafter, the gas refrigerant is condensed in the heat releasing element (5B) of the heat exchanger (5) for heating to be returned to the pump (11).

26 Claims, 21 Drawing Sheets

REFRIGERATING PLANT

TECHNICAL FIELD

The present invention relates to a refrigerating apparatus wherein a heat-source-side refrigerant circuit and a use-side refrigerant circuit are connected to each other such that heat exchange is allowed therebetween and heat transfer is accomplished between the heat-source-side refrigerant circuit and the use-side refrigerant circuit through the heat exchange. More particularly, the present invention relates to an improved refrigerating apparatus having a use-side refrigerant circuit including a plurality of heat exchangers such that some of the heat exchangers perform heat absorbing operation, while the others perform heat releasing operation.

BACKGROUND ART

There has conventionally been known a refrigerating system comprising a plurality of refrigerant circuits such as one disclosed in Japanese Unexamined Patent Publication No. SHO 62-238951. The refrigerating system of this type comprises a primary refrigerant circuit composed of: a compressor; a heat-source-side heat exchanger; a pressure reducing mechanism;

and a heat-source-side heat exchanging part of a middle heat exchanger which are connected to each other by refrigerant piping and a secondary refrigerant circuit composed of a pump, a use-side heat exchanging part of the middle heat exchanger, and a use-side heat exchanger which are connected to each other by the refrigerant piping. In the middle heat exchanger, heat is exchangeable between the heat-source-side heat exchanging part and the use-side heat exchanging part. In the case of applying the system to an air conditioner, the use-side heat exchanger is disposed in a room.

In such a structure, indoor air conditioning is performed by causing a heat exchange between the primary refrigerant circuit and the secondary refrigerant circuit by means of the middle heat exchanger and transferring heat from the primary refrigerant circuit to the secondary refrigerant circuit.

As an example of a refrigerating system having a plurality of use-side heat exchangers each capable of selectively performing heat absorbing operation and heat releasing operation, there is an apparatus disclosed in Japanese Unexamined Patent Publication No. HEI 6-82110. The primary refrigerant circuit of the apparatus has a primary heat exchanger for heating and a primary heat exchanger for cooling. On the other hand, the secondary refrigerant circuit thereof has a circuit for heating and a circuit for cooling. In the circuit for heating, a secondary heat exchanger for heating which exchanges heat with the primary heat exchanger for heating, an indoor heat exchanger for heating, and a pump are connected successively. In the circuit for cooling, a secondary heat exchanger for cooling which exchanges heat with the primary heat exchanger for cooling, an indoor heat exchanger for cooling, and a pump are connected successively.

In the structure, if a cooling load is larger than a heating load, the heat-source-side heat exchanger of the primary refrigerant circuit is used as a condenser. Conversely, if the heating load is larger than the cooling load, the heat-source-side heat exchanger of the primary refrigerant circuit is used as an evaporator. This enables some of the use-side heat exchangers and the others thereof to simultaneously and individually perform heat absorbing operation and heat releasing operation in accordance with an air conditioning load.

Problems to be Solved by the Invention

The primary refrigerant circuit, the secondary heat exchanger for heating, and the secondary heat exchanger for cooling are contained in an outdoor unit of the foregoing apparatus in which the plurality of use-side heat exchangers are capable of simultaneously and individually performing the heat absorbing operation and the heat releasing operation. On the other hand, the indoor heat exchanger for heating and the indoor heat exchanger for cooling are contained in each of indoor units. The outdoor unit and the indoor unit are connected to each other by four connecting pipes. Specifically, the outdoor unit and the indoor unit are connected to each other by outgoing and incoming pipes for the heating circuit and outgoing and incoming pipes for the cooling circuit.

In the apparatus of this type, there has been a request for a reduction in the number of connecting pipes in order to provide a simpler structure and a simpler installing operation. However, since each of the heating circuit and the cooling circuit requires the outgoing pipe and the incoming pipe in the foregoing structure, the requirement cannot be satisfied.

The present invention has been achieved in view of the foregoing and it is therefore an object of the present invention to provide a secondary refrigerant system comprising a plurality of use-side heat exchangers, which is a refrigerating apparatus wherein the heat exchangers are capable of simultaneously and individually performing heat absorbing operation and heat releasing operation and a reduced number of connecting pipes are provided.

DISCLOSURE OF THE INVENTION

Outline of the Invention

The present invention provides a plurality of heat exchangers in a use-side part and causes the heat exchangers to perform heat releasing operation and heat absorbing operation, while allowing the use-side part and a heat-source-side part to be connected to each other by two gas pipes.

Means for Solving the Problems

Specifically, first solving means as shown in FIG. 1 is for a refrigerating apparatus comprising: a heat-source-side unit (A); use-side units (B, C); and at least one of heat exchangers (12, 14) contained in each of the use-side units (B, C), heat generated in the heat-source-side unit (A) being supplied to the use-side units (B, C), at least one (12) of the heat exchangers forming a heat-release-side heat exchanger (12) for performing heat releasing operation, the other (14) of the heat exchangers forming a heat-absorption-side heat exchanger (14) for performing heat absorbing operation.

The heat-source-side unit (A) includes a heating element (3A), a cooling element (5A), a heat absorbing element (3B) for receiving warm heat from the heating element (3A), and a heat releasing element (5B) for receiving cold heat from the cooling element (5A).

Moreover, transfer means (11), the heat absorbing element (3B), the heat releasing element (5B), and the heat exchangers (12, 14) are connected to each other by a liquid pipe (LL) and gas pipes (GH, GL) to constitute a use-side refrigerant circuit (10) through which a refrigerant circulates.

In addition, in the use-side refrigerant circuit (10), the liquid refrigerant is evaporated in the heat absorbing element (3B) with the warm heat from the heating element (3A), the gas refrigerant flows to the use-side units (B, C) via the gas pipe (GH) and releases heat in the heat-release-side heat exchanger (12) to be condensed, the liquid refrigerant absorbs heat in the heat-absorption-side heat exchanger (14)

to be evaporated, the gas refrigerant flows to the heat-source-side unit (A) via the gas pipe (GL) to be condensed in the heat releasing element (5B) with the cold heat from the cooling element (5A), and then the liquid refrigerant flows into the heat absorbing element (3B).

In the first solving means, the heat-source-side unit (A) and the use-side units (B, C) are connected to each other by the two gas pipes (GH, GL). The gas pipes (GH, GL) enable the circulating operation of the refrigerant in the use-side refrigerant circuit (10), while enabling one heat exchanger (12) and the other heat exchanger (14) to simultaneously perform heat releasing operation and heat absorbing operation, respectively.

As shown in FIG. 2, second solving means is obtained by providing, in the first solving means, a bypass path (20) in the. use-side refrigerant circuit (10) such that the condensed refrigerant in the heat-release-side heat exchanger (12) bypasses the heat-absorption-side heat exchanger (14) to flow into the heat releasing element (5B).

As shown in FIG. 3, third solving means is obtained by providing, in the second solving means, an adjusting mechanism (21) for adjusting a flow rate of the refrigerant bypassing the heat-absorption-side heat exchanger (14), which is disposed in the bypass path (20).

Fourth solving means is obtained by composing, in the third solving means, the adjusting mechanism (21) of a flow rate adjusting valve (21) the opening rate of which is adjustable. There is further provided opening rate adjusting means for increasing the opening rate of the flow rate adjusting valve (21) as a required amount of heat to be absorbed by the heat-absorption-side heat exchanger (14) is smaller than a required amount of heat to be released from the heat-release-side heat exchanger (12).

In these solving means, it is possible to adjust the capability of the heat-release-side heat exchanger (12) to be higher than the capability of the heat-absorption-side heat exchanger (14). Accordingly, the structure is effective when a request for heat release is more urgent than a request for heat absorption. In the fourth solving means, in particular, the amount of use-side refrigerant flowing through the bypass path (20) is increased as the capability required of the heat-absorption-side heat exchanger (14) is lower than the capability required of the heat-release-side heat exchanger (12), whereby the respective capabilities of the heat exchangers (12, 14) are adjusted.

As shown in FIG. 4, fifth solving means is obtained by providing, in the first solving means, a bypass path (25) in the use-side refrigerating circuit (10) such that the condensed refrigerant in the heat releasing element (SB) bypasses the heat absorbing element (3B) and flows into the heat-release-side heat exchanger (12).

As shown in FIG. 5, sixth solving means is obtained by providing, in the fifth solving means, an adjusting mechanism (26) for adjusting a flow rate of the refrigerant bypassing the heat absorbing element (3B), which is disposed in the bypass path (25).

Seventh solving means is obtained by composing, in the sixth solving means, the adjusting mechanism (26) of a flow rate adjusting valve (26) the opening rate of which is adjustable. There is further provided opening rate adjusting means for increasing the opening rate of the flow rate adjusting valve (26) as a required amount of heat to be released from the heat-release-side heat exchanger (12) is smaller than a required amount of heat to be absorbed by the heat-absorption-side heat exchanger (14).

In these solving means, it is possible to adjust the capability of the heat-absorption-side heat exchanger (14) to be higher than the capability of the heat-release-side heat exchanger (12). Accordingly, the solving means are effective when a request for heat absorption is more urgent than a request for heat release. In the seventh solving means, in particular, the amount of use-side refrigerant flowing through the bypass path (24) is increased as the capability required of the heat-release-side heat exchanger (12) is lower than the capability required of the heat-absorption-side heat exchanger (14), whereby the respective capabilities of the heat exchangers (12, 14) are adjusted.

As shown in FIGS. 6 to 8, eighth solving means is obtained by connecting, in the first solving means, liquid passage pipes (30, 35, 40) between a first liquid pipe (LL) providing a connection between the heat releasing element (5B) and the heat absorbing element (3B) and a second liquid pipe (LL) providing a connection between the heat-release-side heat exchanger (12) and the heat-absorption-side heat exchanger (14), the liquid passage pipes (30, 35, 40) allowing the refrigerant to flow between the first pipe (LL) and the second pipe (LL).

As shown in FIG. 6, ninth solving means is obtained by providing, in the eighth solving means, the transfer means (11), which is disposed in the first liquid pipe (LL). Moreover, the liquid passage pipe (30) has an upstream end connected to the second liquid pipe (LL) and a downstream end connected between the transfer means (11) and the heat releasing element (5B) in the first liquid pipe (LL).

Tenth solving means is obtained by providing, in the ninth solving means, a flow rate adjusting valve (31) the flow rate of which is adjustable in the liquid passage pipe (30). There is further provided opening rate adjusting means for increasing an amount of refrigerant flowing through the liquid passage pipe (30) by increasing the opening rate of the flow rate adjusting valve (31) as a required amount of heat to be absorbed by the heat-absorption-side heat exchanger (14) is smaller than a required amount of heat to be released from the heat-release-side heat exchanger (12).

As shown in FIG. 7, eleventh solving means is obtained by providing, in the eighth solving means, the transfer means (11), which is disposed in the first liquid pipe (LL). Moreover, the liquid passage pipe (35) has an upstream end connected between the transfer means (11) and the heat releasing element (5B) in the first liquid pipe (LL) and a downstream end connected to the second liquid pipe (LL).

Twelfth solving means is obtained by providing, in the eleventh solving means, a flow rate adjusting valve (36) the opening rate of which is adjustable in the liquid passage pipe (35). There is further provided opening rate adjusting means for increasing an amount of refrigerant flowing through the liquid passage pipe (35) by increasing the opening rate of the flow rate adjusting valve (36) as a required amount of heat to be released from the heat-release-side heat exchanger (12) is smaller than a required amount of heat to be absorbed by the heat-absorption-side heat exchanger (14).

As shown in FIG. 8, thirteenth solving means is obtained by disposing, in the eighth solving means, two transfer means (11*a*, 11*b*), which are disposed in the first liquid pipe (LL). Moreover, a liquid passage pipe (40) is connected between the two transfer means (11*a*, 11*b*) in the first liquid pipe (LL).

Fourteenth solving means is obtained by providing, in the thirteenth solving means, capability adjusting means for adjusting the transfer capability of the downstream transfer means (11*b*) to be higher than the transfer capability of the upstream transfer means (11*a*) as a required amount of heat to be absorbed by the heat-absorption-side heat exchanger (14) is smaller than a required amount of heat to be released from the heat-release-side heat exchanger (12), while adjusting the transfer capability of the upstream transfer means (11*a*) to be higher than the transfer capability of the downstream transfer means (11*b*) as a required amount of heat to be released from the heat-release-side heat exchanger (12) is smaller than a required amount of heat to be absorbed by the heat-absorption-side heat exchanger (14).

As shown in FIG. 9, fifteenth solving means is obtained by providing, in the eighth solving means, the transfer means (11), which is disposed in the first liquid pipe (LL). The portion of the liquid passage pipe (40) connected to the first liquid pipe (LL) is divided into a first branch pipe (40*a*) and a second branch pipe (40*b*), the first branch pipe (40*a*) being connected between the heat releasing element (5B) and the transfer means (11) in the first liquid pipe (LL), the second branch pipe (40*b*) being connected between the transfer means (11) and the heat absorbing element (3B) in the first liquid pipe (LL). In addition, a first flow rate control valve (41a) and a second flow rate control valve (40*b*) are provided in the first branch pipe (40*a*) and in the second branch pipe (40*b*), respectively.

Sixteenth solving means is obtained by providing, in the fifteenth solving means, open/close control means for opening the first flow rate control valve (41*a*) and closing the second flow rate control valve (41*b*) when a required amount of heat to be absorbed by the heat-absorption-side heat exchanger (14) is smaller than a required amount of heat to be released from the heat-release-side heat exchanger (12), while opening the second flow rate control valve (41*b*) and closing the first flow rate control valve (41*a*) when a required amount of heat to be released from the heat-release-side heat exchanger (12) is smaller than a required amount of heat to be absorbed by the heat-absorption-side heat exchanger (14).

As shown in FIG. 10, seventeenth solving means is obtained by providing, in the eighth solving means, the transfer means (11), which is disposed in the first liquid pipe (LL). The portion of the liquid passage pipe (40) connected to the first liquid pipe (LL) is divided into a first branch pipe (40*a*) and a second branch pipe (40*b*), the first branch pipe (40*a*) being connected to the gas pipe (GL) upstream of the heat releasing element (5B), the second branch pipe (40*b*) being connected between the transfer means (11) and the heat absorbing element (3B) in the first liquid pipe (LL). A first flow rate control valve (42*a*) and a second flow rate control valve (42*b*) are provided in the first branch pipe (40*a*) and in the second branch pipe (40*b*).

Eighteenth solving means is obtained by providing, in the seventeenth solving means, opening rate adjusting means for adjusting respective opening rates of the flow rate control valves (42*a*, 42*b*) such that the opening rate of the first flow rate control valve (42*a* ) is higher than the opening rate of the second flow rate control valve (42*b*) as a required amount of heat to be absorbed by the heat-absorption-side heat exchanger (14) is smaller than a required amount of heat to be released from the heat-release-side heat exchanger (12) and that the opening rate of the second flow rate control valve (42*b*) is higher than the opening rate of the first flow rate control valve (42*a* ) as a required amount of heat to be released from the heat-release-side heat exchanger (12) is smaller than a required amount of heat to be absorbed by the heat-absorption-side heat exchanger (14).

In these solving means, the respective capabilities of the heat exchangers (12, 14) can be changed by allowing at least a part of the refrigerant circulating through the use-side refrigerant circuit (10) to flow through the liquid passage pipes (30, 35, 40).

Specifically, in the ninth and tenth solving means, the capability of the heat-release-side heat exchanger (12) can be adjusted to be higher than the capability of the heat-absorption-side heat exchanger (14) by allowing a part of the refrigerant to bypass the heat-absorption-side heat exchanger (14).

In the eleventh and twelfth solving means, the capability of the heat-absorption-side heat exchanger (14) can be adjusted to be higher than the capability of the heat-release-side heat exchanger (12) by allowing a part of the refrigerant to bypass the heat-release-side heat exchanger (12).

In the fifteenth and sixteenth solving means, the respective capabilities of the heat exchangers (12, 14) can be changed with the provision of only one transporting means (11). In the seventeenth and eighteenth means, the refrigerant that has flown out of the heat-absorption-side heat exchanger (14) can surely be liquefied in the heat releasing element (5B) and the ingress of the refrigerant in a gas phase into the transporting means (11) can be circumvented, which is particularly effective when the transporting means (11) is composed of a mechanical pump.

As shown in FIG. 11, nineteenth solving means is obtained by providing, in any one of the first to eighteenth solving means, a plurality of heat-source-side units (A1, A2). Respective gas sides of the heat absorbing elements (3B) of the individual heat-source-side units (A1, A2) are connected to each other and to the heat-release-side heat exchanger (12) via the gas pipe (GH), while respective gas sides of the heat releasing elements (SB) of the individual heat-source-side units (A1, A2) are connected to each other and to the heat-absorption-side heat exchanger (14) via the gas pipe (GL).

In this solving means, the extent to which the capability of each of the heat exchangers (12, 14) is adjustable is enlarged by controlling the respective capabilities of the heat-source-side units (A1, A2).

As shown in FIG. 12, twentieth solving means is obtained by providing, in the any one of first to eighteenth solving means, an auxiliary heat-source-side unit (A2). The auxiliary heat-source-side unit (A2) is switchable between a heat-release assisting action of supplying the gas refrigerant to the heat-release-side heat exchanger (12) and recovering the liquid refrigerant flowing out of the heat-release-side heat exchanger (12) without allowing the refrigerant to pass through the heat-absorption-side heat exchanger (14) and a heat-absorption assisting action of supplying the liquid refrigerant to the heat-absorption-side heat exchanger (14) without allowing the refrigerant to pass through the heat-release-side heat exchanger (12) and recovering the gas refrigerant flowing out of the heat-absorption-side heat exchanger (14).

Twenty-first solving means is obtained by providing, in the twentieth solving means, transfer means (50), a heat exchanger (52), and flow-path switching means (51), which are disposed in the auxiliary heat-source-side unit (A2). The heat-release assisting action of the auxiliary heat-source-side unit (A2) includes switching the flow-path switching means (51), supplying the gas refrigerant ejected from the transfer means (50) and evaporated in the heat exchanger (52) to the heat-release-side eat exchanger (12), and recovering, in the transfer means (50), he liquid refrigerant condensed in the heat-release-side heat exchanger (12). On the other hand, the heat-absorption assisting action of the auxiliary heat-source-side unit (A2) includes switching the flow-path switching means (51), supplying the liquid refrigerant ejected from the transfer means (50) to the heat-absorption-side heat exchanger (14), and condensing, in the heat exchanger (52), the gas refrigerant passing through the heat-absorption-side heat exchanger (14) and circulating through the use-side refrigerant circuit (10) such that the refrigerant is recovered by the transfer means (50).

In this solving means, the capability of the heat-release-side heat exchanger (12) can be enhanced during the heat-release assisting action, while the capability of the heat-absorption-side heat exchanger (14) can be enhanced during the heat-absorption assisting action.

Twenty-second solving means is obtained by providing, in the twenty-first solving means, switch control means for switching the flow rate switching means (51) such that the heat-release assisting action is performed when a required amount of heat to be released from the heat-release-side heat exchanger (12) is larger than a required amount of heat to be absorbed by the heat-absorption-side heat exchanger (14) and the heat-absorption assisting action is performed when the required amount of heat to be absorbed by the heat-absorption-side heat exchanger (14) is larger than a required amount of heat to be released from the heat-release-side heat exchanger (12).

As shown in FIGS. 13 to 22, twenty-third solving means is obtained by providing, in any one of the first to twenty-second solving means, switching means (D1, D2) for selectively switching the respective gas sides of the heat exchangers (12, 14) between the heat absorbing element (3B) and the heat releasing element (5B) to provide connections between the respective gas sides and the selected ones of the elements in the use-side refrigerant circuit (10).

In this solving means, it is possible to arbitrarily switch each of the heat exchangers (12, 14) between the heat releasing operation and the heat absorbing operation.

Twenty-fourth solving means is obtained by providing, in the twenty-third solving means, first switching valves (55*a*, 55*c*) for switching the respective gas sides of the heat exchangers (12, 14) and the heat absorbing element (3B) between a communicating state and an interrupted state and second switching valves (55*b*, 55*d*) for switching the respective gas sides of the heat exchangers (12, 14) and the heat releasing element (5B) between the communicating state and the interrupted state, which are disposed in the switching means (D1, D2).

There is further provided switch control means for controlling the switching means (D1, D2) such that the heat exchangers (12, 14) connected to the switching means (D1, D2) being formed into heat-release-side heat exchangers (12, 14) by opening the first switching valves (55*a*, 55*c*) and closing the second switching valves (55*b*, 55*d*) in one of the switching means (D1, D2) and that the heat exchangers (12, 14) connected to the other of the switching means (D1, D2) being formed into heat-absorption-side heat exchangers (12, 14) by closing the first switching valves (55*a*, 55*c*) and opening the second switching valves (55*b*, 55*d*) in the other of the switching means (D1, D2)

Twenty-fifth solving means is obtained by using, in any one of the first to twenty-fourth solving means, a mechanical pump as transfer means (11).

Twenty-sixth solving means is obtained by providing, in any one of first to twenty-fourth solving means, at least one of pressure increasing means (71) for heating the liquid refrigerant and generating a high pressure and pressure reducing means (72) for cooling the gas refrigerant and generating a low pressure, which are disposed in the transfer means (11). The transfer means (11) generates a driving force for circulating the refrigerant in the use-side refrigerant circuit (10) with the pressure generated by the pressure increasing means (71) or by the pressure reducing means (72).

In this solving means, the refrigerant in the use-side refrigerant circuit (10) can surely be circulated. In the twenty-sixth solving means, in particular, a circulation driving force can be obtained by effectively using a phase shift in the refrigerant.

Effects

With the first solving means, therefore, heat releasing operation and heat absorbing operation can be performed simultaneously in one heat exchanger (12) and in the other heat exchanger (14), respectively, by connecting the heat-source-side unit (A) and the use-side units (B, C) by the two gas pipes (GE, GL). As a result, it becomes possible to provide a refrigerating apparatus capable of simultaneously performing heat releasing operation and heat absorbing operation and having a simpler structure and reduce the manufacturing cost therefor.

Since the number of connecting points is reduced as the number of pipes is reduced, the apparatus can be installed by simpler installing operation.

In the second to fourth solving means, a bypass path (20) is provided for allowing the refrigerant to bypass the heat-absorption-side heat exchanger (14). Accordingly, the capability of the heat-release-side heat exchanger (12) can be adjusted to be higher than the capability of the heat-absorption-side heat exchanger (14) with a simple structure.

In the fifth to seventh solving means, a bypass path (25) is provided for allowing the refrigerant to bypass the heat-absorbing element (3B). Accordingly, the capability of the heat-absorption-side heat exchanger (14) can be adjusted to be higher than the capability of the heat-release-side heat exchanger (12) with a simple structure.

In the eighth to eighteenth solving means, liquid passage pipes (30, 35, 40) are provided between the first liquid pipe (LL) and the second liquidpipe (LL). As a result, it becomes possible to change the respective capabilities of the heat exchangers (12, 14) by allowing at least a part of the refrigerant circulating through the use-side refrigerating circuit (10) to flow through the liquid passage pipes (30, 35, 40) and thereby increasing the versatility of the apparatus.

With the fifteenth solving means, in particular, the respective capabilities of the heat exchangers (12, 14) can be changed with the provision of only one transporting means (11).

With the seventeenth solving means, the refrigerant that has flown out of the heat-absorption-side heat exchanger (14) can surely be liquefied in the heat releasing element (5B) and the ingress of the refrigerant in a gas phase into the transporting means (11) can be circumvented. In this case, the structure is particularly effective when the transporting means (11) is composed of a mechanical pump since the breakdown of the pump is prevented, resulting in improved reliability.

In the nineteenth solving means, the plurality of heat-source-side units (A1, A2) are provided and the respective heat absorbing elements (3B) and heat releasing elements (5B) thereof are connected in parallel. As a result, the extent to which the respective abilities of the heat exchangers (12, 14) are adjustable can be enlarged by controlling the respective capabilities of the heat-source-side units (A1, A2), whereby the versatility is increased.

Since the plurality of heat-source-side units (A1, A2) are provided in the twentieth to twenty-second solving means and each of the heat-source-side unit A2 is switchable between the heat-release assisting action and heat-absorption assisting action, the respective capabilities of the heat exchangers (12, 14) are variable.

In the twenty-third and twenty-fourth means, the respective gas sides of the heat exchangers (12, 14) are in selective communication with the heat absorbing element (3B) or with the heat releasing element (5B). Accordingly, each of the heat exchangers (12, 14) can be switched arbitrarily between heat releasing action and the heat absorbing action. In the case where the refrigerating apparatus is applied to the air conditioner, e.g., there can be implemented a so-called cooling/heating free air conditioner in which each of the heat exchangers is independently switchable between cooling and heating operations.

With the twenty-fifth and twenty-sixth solving means, the refrigerant in the use-side refrigerant circuit (10) can surely be circulated.

With the twenty-seventh solving means, it is possible to cause the refrigerant to perform more effective and reliable circulating operation than in the case where a mechanical pump is used.

BEST MODE FOR IMPLEMENTING THE INVENTION

Figure 1:
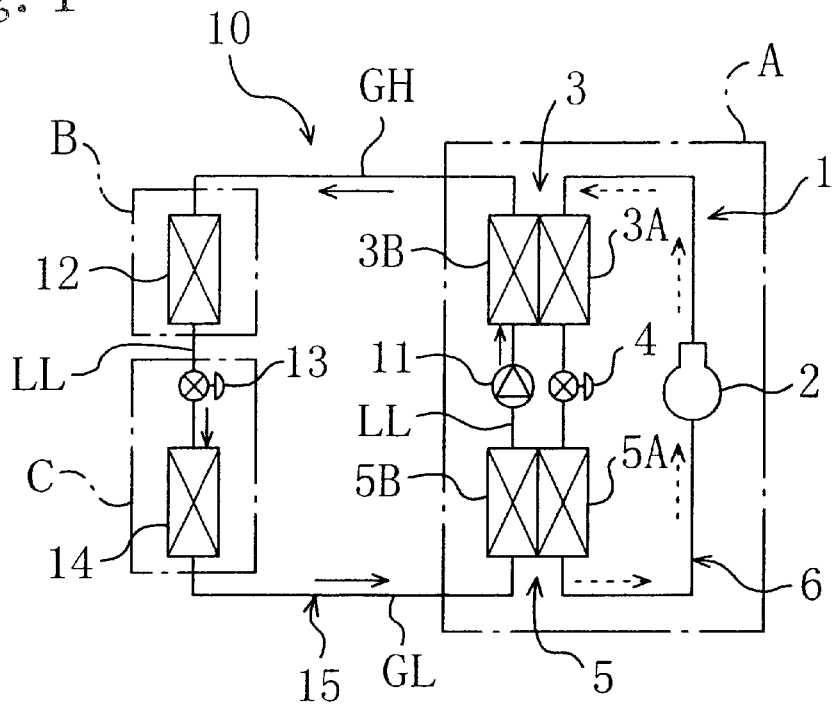
FIG. 1 is a refrigerant piping diagram of Embodiment 1.

Referring to the drawings, the embodiments of the present invention will be described.

Embodiment 1

In the present embodiment, a refrigerating apparatus according to the present invention is applied to a refrigerant circuit of an air conditioner.

Description of Refrigerant Circuit

The circuit structure of the refrigerant circuit according to the present embodiment will be described first with reference to FIG. 1.

The refrigerant circuit according to the present embodiment is a so-called secondary refrigerant system comprising a primary refrigerant circuit (1) as a heat source and a secondary refrigerant circuit (10) as a use-side refrigerant circuit. Heat transfer is performed between the primary refrigerant circuit (1) and the secondary refrigerant circuit (10) as the use-side refrigerant circuit, thereby performing cooling and heating operations in a plurality of rooms.

A description will be given to each of the refrigerant circuits (1, 10).

The primary refrigerant circuit (1) is composed of a compressor (2), a heat releasing element (3A) of a heat exchanger (3) for heating, an electromotive expansion valve (4), and a heat absorbing element (5A) of a heat exchanger (5) for cooling which are connected successively by primary refrigerant piping (6) such that a heat-source-side refrigerant is circulatable. The heat releasing element (3A) of the heat exchanger (3) for heating forms a heating element in accordance with the present invention. The heat absorbing element (5A) of the heat exchanger (5) for cooling forms a cooling element in accordance with the present invention.

On the other hand, the secondary refrigerant circuit (10) is composed of a pump (11) as transfer means, a heat absorbing element (3B) of the heat exchanger (3) for heating, a first indoor heat exchanger (12) as a heat-release-side heat exchanger, an electromotive valve (13), a second indoor heat exchanger (14) as a heat-absorption-side heat exchanger, and a heat releasing element (SB) of the heat exchanger (5) for cooling which are connected successively by secondary refrigerant piping (15).

The secondary refrigerant piping (15) providing a connection between the heat absorbing element (3B) of the heat exchanger (3) for heating and the first indoor heat exchanger (12) forms a high-pressure gas pipe (GH). The secondary refrigerant piping (15) providing a connection between the second indoor heat exchanger (14) and the heat releasing element (SB) of the heat exchanger (5) for cooling forms a low-pressure gas pipe (GL).

On the other hand, the secondary refrigerant piping (15) providing a connection between the heat releasing element (5B) of the heat exchanger (5) for cooling and the heat absorbing element (3B) of the heat exchanger (3) for heating forms a liquid pipe (LL) as a first liquid pipe, while the refrigerant piping (15) providing a connection between the first indoor heat exchanger (12) and the second indoor heat exchanger (14) forms a liquid pipe (LL) as a second liquid pipe.

In the structure, when the refrigerant circulates through each of the refrigerant circuits (1, 10), heat is released from the heat-source-side refrigerant to the use-side refrigerant through a heat exchange in the heat exchanger (3) for heating. Then, heat is released from the use-side refrigerant to the heat-source-side refrigerant through a heat exchange in the heat exchanger for (5) cooling.

The foregoing primary refrigerant circuit (1), pump (11), heat exchanger (3) for heating, and heat exchanger (5) for cooling are contained in an outdoor unit (A) as a heat-source-side unit. On the other hand, the first indoor heat exchanger (12) is contained in a first indoor unit (B) as a use-side unit, while the electromotive valve (13) and the second indoor heat exchanger (14) are contained in a second indoor unit (C) as the use-side unit. The outdoor unit (A) is disposed outdoor, while the indoor units (B, C) are disposed in individual rooms.

Description of Circulating Operation of Refrigerant

Next, a description will be given to the circulating operation of a refrigerant.

During the circulating operation, the compressor (2) of the primary refrigerant circuit (1) and the pump (11) of the secondary refrigerant circuit (10) are driven with the respective electromotive valves (4, 13) of the refrigerant circuits (1, 10) adjusted to specified opening rates.

In the primary refrigerant circuit (1), the heat-source-side refrigerant which has been ejected from the compressor (2) exchanges heat with the use-side refrigerant in the heat exchanger (3) for heating to be condensed, as indicated by the broken arrows in FIG. 1. The condensed heat-source-side refrigerant is reduced in pressure in the electromotive expansion valve (4) and exchanges heat with the use-side refrigerant in the heat exchanger (5) for cooling to evaporate. Thereafter, the heat-source-side refrigerant is recovered by the compressor (2). The foregoing circulating operation of the heat-source-side refrigerant is performed continuously in the primary refrigerant circuit (1).

In the secondary refrigerant circuit (10), on the other hand, the use-side refrigerant in a liquid phase which has been ejected from the pump (11) exchanges heat with the heat-source-side refrigerant in the heat exchanger (3) for heating to evaporate, as indicated by the solid arrows in FIG. 1. The evaporated use-side refrigerant in a gas phase flows into the first indoor unit (B) through the high-pressure gas pipe (GH). In the first indoor heat exchanger (12), the use-side refrigerant exchanges heat with an indoor air to heat and condense the indoor air.

Then, the use-side refrigerant in a liquid phase flows into the second indoor unit C. In the second indoor heat exchanger (14), the use-side refrigerant which has passed through the electromotive valve (13) exchanges heat with an indoor air to cool and evaporate the indoor air.

Thereafter, the use-side refrigerant in the gas phase passes through the low-pressure gas pipe (GL) and exchanges heat with the heat-source-side refrigerant in the heat exchanger (5) for cooling to be condensed and recovered by the pump (11). The foregoing circulating operation of the use-side refrigerant is performed continuously in the secondary refrigerant circuit (10).

Since the refrigerant performs such circulating operation, the indoor air is heated in the first indoor unit (B), while the indoor air is cooled in the second indoor unit (C). In the case of applying the apparatus of the present invention to a freezer warehouse or the like, the first indoor unit (B) may be installed in an office to be used as a heater in winter, while the second indoor unit (C) may be used to contribute to the cooling operation performed in the freezer warehouse.

It is also possible to dispose the indoor units (B, C) in different rooms such that one of the rooms is heated and the other rooms is cooled.

Effect of the Present Embodiment

As described above, according to the present embodiment, it is sufficient to provide only the high-pressure gas pipe (GH) and the low-pressure gas pipe (GL) as the connecting pipes for connecting the outdoor unit (A) to the indoor units (B, C). It is therefore possible to simultaneously perform heating operation in some of a plurality of rooms and cooling operation in the other rooms by using only two connecting pipes (GH, GL). As a result, the structure of the whole apparatus becomes simpler and the manufacturing cost is reduced. Moreover, since connection points are reduced in number with a reduction in the number of pipes, the apparatus can be installed by simpler installing operation.

Embodiment 2

A description will be given to Embodiment 2 of the present invention with reference to FIG. 2.

In the present embodiment also, the refrigerating apparatus according to the present invention is applied to a refrigerant circuit of an air conditioner, similarly to Embodiment 1 described above.

Since the structure of the primary refrigerant circuit (1) of the present embodiment is the same as in Embodiment 1 described above, the description will be given to only a secondary refrigerant circuit (10).

Figure 2:
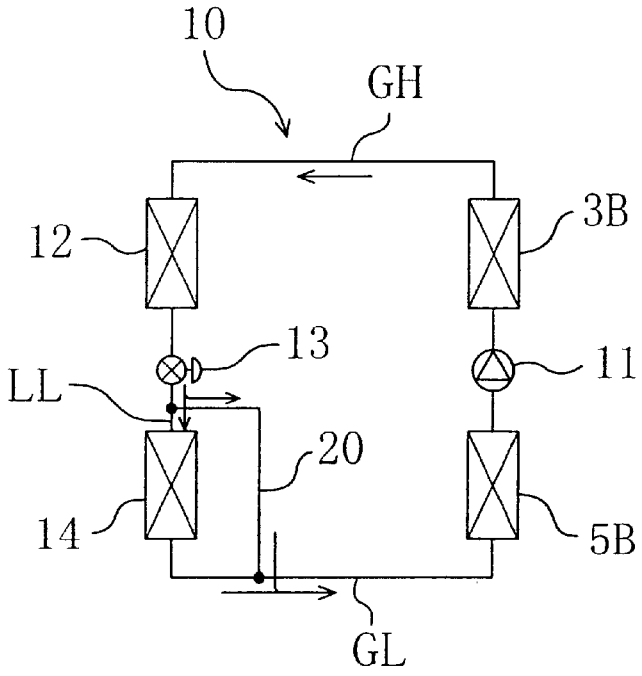
FIG. 2 is a refrigerant piping diagram of Embodiment 2.

In FIG. 2, only the secondary refrigerant circuit (10) is shown.

As shown in FIG. 2, a bypass pipe (20) forming a bypass path which bypasses the secondary indoor heat exchanger (14) is provided in the secondary refrigerant circuit (10) in the air conditioner of the present embodiment. The bypass pipe (20) has one end connected to the liquid pipe (LL) between the electromotive expansion valve (13) and the second indoor heat exchanger (14) and the other end connected to the low-pressure gas pipe (GL) between the second indoor heat exchanger (14) and the heat releasing element (5B) of the heat exchanger (5) for cooling.

The bypass pipe (20) has a diameter smaller than that of the liquid pipe (LL) to allow a part of the use-side refrigerant that has passed through the electromotive valve (13) to bypass the second indoor heat exchanger (14) and flow to the low-pressure gas pipe (GL).

In the structure, a part of the use-side refrigerant that has passed through the electromotive valve (13) during operation flows into the second indoor heat exchanger (14) to contribute to the cooling of the indoor air and then flows out into the low-pressure gas pipe (GL). The remaining part of the use-side refrigerant in a liquid phase or in a vapor-liquid mixed phase flows through the bypass pipe (20) to merge, in the low-pressure gas pipe (GL), with the use-side refrigerant that has passed through the second indoor heat exchanger (14) and flow into the heat releasing element (SB) of the heat exchanger (5) for cooling.

As for the other actions, they are the same as in the case described above in Embodiment 1.

Since a part of the use-side refrigerant is allowed to bypass the second indoor heat exchanger (14) in the present embodiment, it is possible to adjust the heating capability of the first indoor heat exchanger (12) to be higher than the cooling capability of the second indoor heat exchanger (14). Hence, the present embodiment is effective in the case where a heating load is larger than a cooling load (hereinafter, the case will be referred to as a "heating rich state").

Variation of Embodiment 2

A description will be given to a variation of Embodiment 2 described above.

Figure 3:
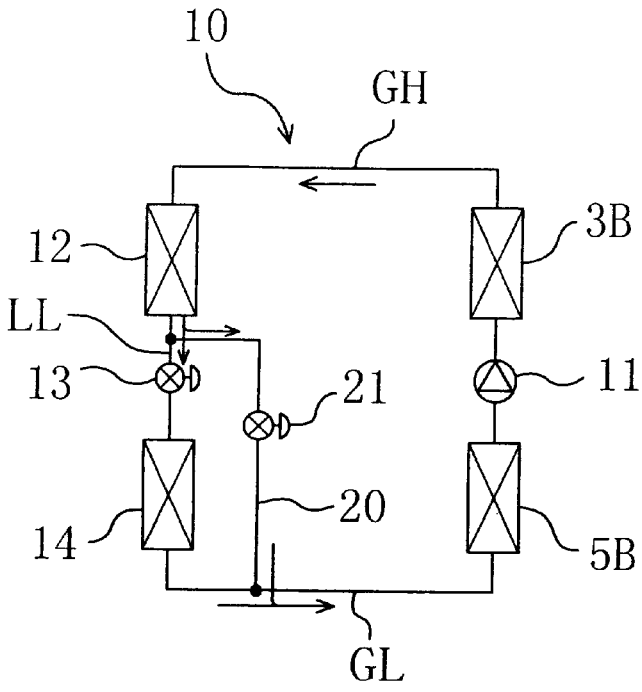
FIG. 3 is a refrigerant piping diagram of a variation of Embodiment 2.

In the present variation, the upstream end of the bypass pipe (20) is connected to the liquid pipe (LL) between the first indoor heat exchanger (12) and the electromotive expansion valve (13), as shown in FIG. 3. An electromotive valve (21) as an adjusting mechanism which enables the adjustment of the flow rate of the refrigerant is provided in the bypass pipe (20).

In addition, opening rate adjusting means for adjusting the opening rate of the electromotive valve (21) is provided in the controller of the present apparatus, though it is not depicted.

In the structure, it is possible to adjust the amount of use-side refrigerant which bypasses the second indoor heat exchanger (14) by controlling the opening rate of the electromotive valve (21). In other words, it is possible to obtain the refrigerant at a proper flow rate in the second indoor heat exchanger (14) in accordance with the cooling load. In a specific control operation, the opening rate of the electromotive valve (21) is increased accordingly as the cooling load is smaller than the heating load such that the amount of refrigerant flowing through the bypass pipe (20) is increased. That is, the cooling capability is suppressed by reducing the amount of refrigerant flowing through the second indoor heat exchanger (14).

Embodiment 3

A description will be given to Embodiment 3 of the present invention with reference to FIG. 4.

In the present embodiment also, the refrigerating apparatus according to the present invention is applied to a refrigerant circuit of an air conditioner. The structure of the primary refrigerant circuit (1) is the same as in Embodiment 1 described above.

Figure 4:
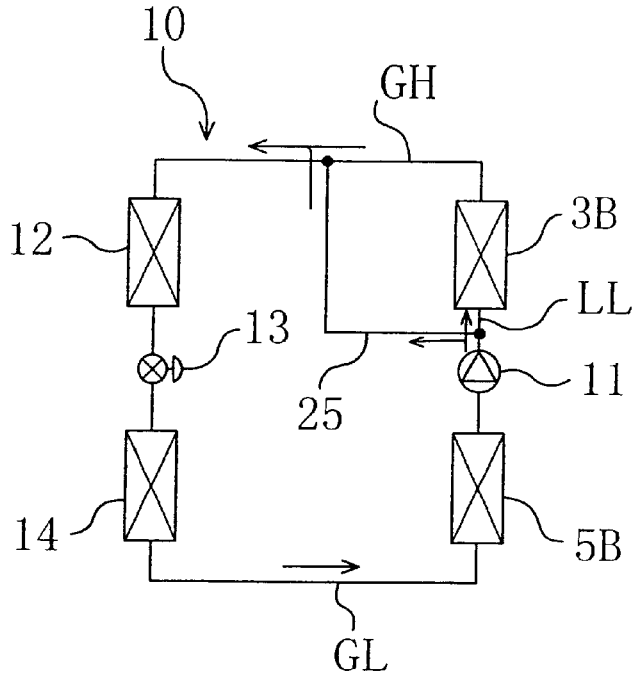
FIG. 4 is a refrigerant piping diagram of Embodiment 3.

FIG. 4 illustrates only the secondary refrigerant circuit (10). A bypass pipe (25) forming a bypass path which bypasses the heat absorbing element (3B) of the heat exchanger (3) for heating is provided in the secondary refrigerant circuit (10) in the air conditioner of the present embodiment.

The bypass pipe (25) has one end connected to the liquid pipe (LL) between the pump (11) and the heat absorbing element (3B) of the heat exchanger (3) for heating and the other end connected to the high-pressure gas pipe (GH) between the heat absorbing element (3B) of the heat exchanger (3) for heating and the first indoor heat exchanger (12).

The bypass pipe (25) has a diameter smaller than that of the liquid pipe (LL) to allow a part of the use-side refrigerant in a liquid phase that has been ejected from the pump (11) to bypass the heat absorbing element (3B) of the heat exchanger (3) for heating and flow into the high-pressure gas pipe (GH).

In the structure, a part of the use-side refrigerant in the liquid phase that has been ejected from the pump (11) during operation flows into the heat absorbing element (3B) of the heat exchanger (3) for heating where it absorbs heat from the heat-source-side refrigerant to evaporate and then flows out into the high-pressure gas pipe (GH). The remaining part of the use-side refrigerant in a liquid phase flows through the bypass pipe (25) to merge, in the high-pressure gas pipe (GH), with the use-side refrigerant that has passed through the heat absorbing element (3B) of the heat exchanger (3) for heating and flow into the first indoor heat exchanger (12).

As for the other actions, they are the same as in Embodiment 1 described above.

Thus, since a part of the use-side refrigerant is allowed to bypass the heat absorbing element (3B) of the heat exchanger (3) for heating in the present embodiment, the amount of heat received by the use-side refrigerant from the heat-source-side refrigerant can be set smaller than the amount of heat given by the use-side refrigerant to the heat-source-side refrigerant. In short, the present embodiment reduces the amount of heat released from the first indoor heat exchanger (12). Hence, the structure of the present embodiment is effective in the case where the cooling load is larger than the heating load (hereinafter, the case will be referred to as a "cooling rich state").

Variation of Embodiment 3

A description will be given to a variation of Embodiment 3 described above.

In the present variation, an electromotive valve (26) as an adjusting mechanism capable of adjusting the flow rate of the refrigerant is provided in the bypass pipe (25), as shown in Figure In addition, opening rate adjusting means for adjusting the opening rate of the electromotive valve (26) is provided in the controller of the present apparatus, though it is not depicted.

In the structure, it is possible to adjust the amount of use-side refrigerant which bypasses the heat absorbing element (3B) of the heat exchanger (3) for heating by controlling the opening rate of the electromotive valve (26). In other words, it becomes possible to obtain the refrigerant at a proper flow rate in the heat absorbing element (3B) of the heat exchanger (3) for heating in accordance with the heating load. In a specific control operation, the opening rate of the electromotive valve (26) is increased accordingly as the heating load is smaller than the cooling load such that the amount of refrigerant flowing through the bypass pipe (25) is increased. That is, the heating capability is suppressed by reducing the amount of refrigerant flowing through the heat absorbing element (3B) of the heat exchanger (3) for heating.

Circuit Structure Capable of Halting One of Indoor Units

Each of Embodiments 4 to 8 described above has adopted a circuit structure which allows the circulation of the use-side refrigerant even if one of the indoor units (B, C) is at a halt.

Embodiment 4

Figure 6:
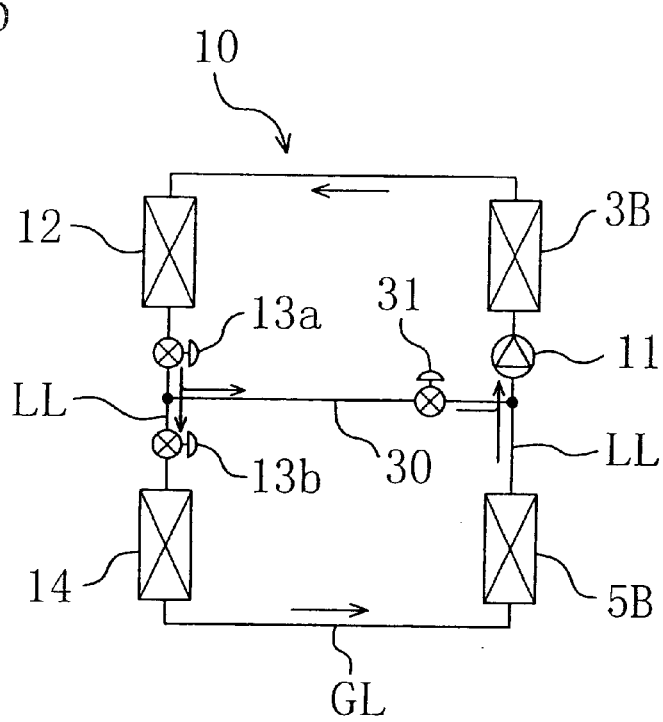
FIG. 6 is a refrigerant piping diagram of Embodiment 4.

In the present embodiment, two electromotive valves (13*a*, 13*b*) are provided in the liquid pipe (LL) between the first indoor heat exchanger (12) and the second indoor heat exchanger (14), as shown in FIG. 6.

A liquid return pipe (30) as a liquid passage pipe is connected between the liquid pipe (LL) between the electromotive valves (13*a*, 13*b*) and the liquid pipe (LL) upstream of the pump (11) (suction side). The liquid return pipe (30) is provided with an electromotive valve (31).

In addition, opening rate adjusting means for adjusting the opening rate of the electromotive valve (31) is provided in the controller of the present apparatus, though it is not depicted.

In the structure, the electromotive valve (13*a*) upstream of the liquid pipe (LL) is opened and the opening rate of the downstream electromotive valve (13*b*) is reduced in the heating rich state. On the other hand, the electromotive valve (31) of the liquid return pipe (30) is adjusted to a specified opening rate.

As a result, a part of the use-side refrigerant in a liquid phase that has passed through the first indoor heat exchanger (12) and the upstream electromotive valve (13*a*) flows into the second indoor heat exchanger (14) to contribute to the cooling of the indoor air, flows out into the low-pressure gas pipe (GL), is condensed in the heat releasing element (5B) of the heat exchanger (5) for cooling, and returns to the suction side of the pump (11), while the remaining part of the use-side refrigerant flows through the liquid return pipe (30) and returns to the suction side of the pump (11) without undergoing a phase change. In short, the use-side refrigerant flowing through the liquid return pipe (30) bypasses the second indoor heat exchanger (14).

As for the other actions, they are the same as in Embodiment 1 described above.

Thus, according to the present embodiment, the adjustment of the opening rates of the electromotive valves (13*a*, 13*b*) and (31) allows a part of the use-side refrigerant to bypass the second indoor heat exchanger (14) and the heat releasing element (5B) of the heat exchanger (5) for cooling. As a result, it becomes possible to adjust the heating capability of the first indoor heat exchanger (12) to be higher than the cooling capability of the second indoor heat exchanger (14).

Therefore, the structure of the present embodiment is effective in the case where the heating load is larger than the cooling load, similarly to the case described above in Embodiment 2. In a specific control operation, the opening rate of the electromotive valve (31) is increased accordingly as the cooling load is smaller than the heating load, whereby the amount of refrigerant flowing through the liquid return pipe (30) is increased. Briefly, the cooling capability is suppressed by reducing the amount of refrigerant flowing through the second indoor heat exchanger (14) and the heat releasing element (5B) of the heat exchanger (5) for cooling.

If the cooling load is equal to the heating load, the electromotive valve (31) of the liquid return pipe (30) is closed. As a result, the same circulating operation of the refrigerant as in the case described above in Embodiment 1 is performed.

If there is no cooling load, the downstream electromotive valve (13*b*) is closed completely. In this case, the use-side refrigerant circulates only between the heat absorbing element (3B) of the heat exchanger (3) for heating and the first indoor heat exchanger (12) and is prevented from flowing into the second indoor heat exchanger (14). That is, the circulating operation of the refrigerant is such that only the heating capability is obtainable from the first indoor heat exchanger (12).

To implement such an operating action, the amount of heat for evaporating the condensed heat-source-side refrigerant is insufficient in the primary refrigerant circuit (1). Therefore, an air heat exchanger or the like for compensating for the insufficient amount of heat is needed.

Embodiment 5

In contrast to Embodiment 4 described above in which only the heating capability is obtainable from the first indoor heat exchanger (12), only the cooling capability is obtainable from the second indoor heat exchanger (14) in the present embodiment. A description will be given herein only to portions different from Embodiment 4 described above.

Figure 7:
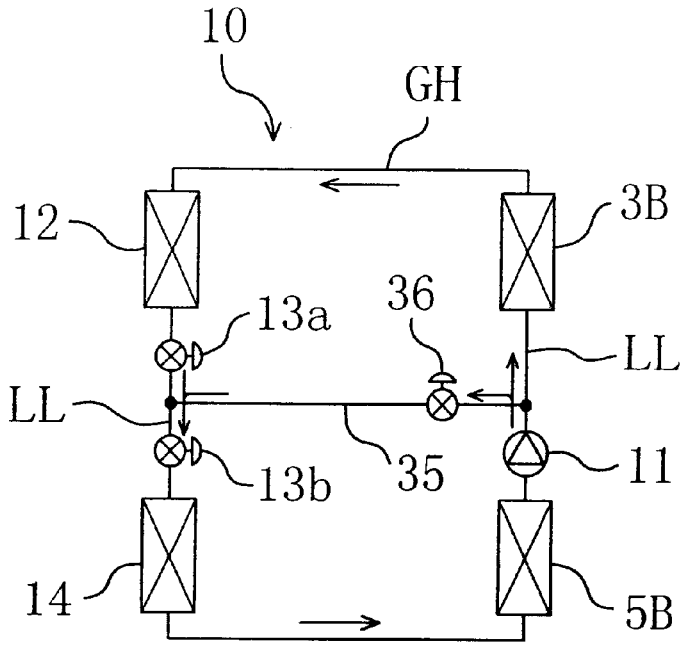
FIG. 7 is a refrigerant piping diagram of Embodiment 5.

As shown in FIG. 7, the secondary refrigerant circuit (10) of the present embodiment is provided with a liquid supply pipe (35) as the liquid passage pipe in place of the liquid return pipe (30) of Embodiment 4 described above. The liquid supply pipe (35) has one end connected to the liquid pipe (LL) between the electromotive valves (13*a*, 13*b*) and the other end connected to the liquid pipe (LL) downstream of the pump (11) (ejection side). An electromotive valve (36) is also provided in the liquid supply pipe (35).

In addition, opening rate adjusting means for adjusting the opening rate of the electromotive valve (36) is also provided in the controller of the present apparatus, though it is not depicted.

In the structure, the downstream electromotive valve (13*b*) of the liquid pipe (LL) is opened and the opening rate of the upstream electromotive valve (13*a*) is reduced in the cooling rich state. On the other hand, the electromotive valve (36) of the liquid supply pipe (35) is adjusted to a specified opening rate.

As a result, a part of the use-side refrigerant that has ejected from the pump (11) flows into the heat absorbing element (3B) of the heat exchanger (3) for heating where it absorbs heat from the heat-source-side refrigerant to evaporate, and then flows into the high-pressure gas pipe (GH). Thereafter, the use-side refrigerant flows through the first indoor heat exchanger (12) to contribute to the heating of the indoor air.

After the remaining part of the use-side refrigerant flows through the liquid supply pipe (35), it merges with the use-side refrigerant that has passed through the first indoor heat exchanger (12) and flows into the second indoor heat exchanger (14) through the downstream electromotive valve (13*b*). As for the other actions, they are the same as in the case described above in Embodiment 1.

Thus, according to the present embodiment, the adjustment of the opening rates of the electromotive valves (13*a*, 13*b*) and (36) allows a part of the use-side refrigerant to bypass the heat absorbing element (3B) of the heat exchanger (3) for heating and the first indoor heat exchanger (12). As a result, it becomes possible to adjust the cooling capability of the second indoor heat exchanger (14) to be higher than the heating capability of the first indoor heat exchanger (12).

Therefore, the structure of the present embodiment is effective in the case where the cooling load is larger than the heating load, similarly to the case described above in Embodiment 3. In a specific control operation, the opening rate of the electromotive valve (36) is increased accordingly as the heating load is smaller than the cooling load, whereby the amount of refrigerant flowing through the liquid supply pipe (35) is increased. Briefly, the heating capability is suppressed by reducing the amount of refrigerant flowing through the heat absorbing element (3B) of the heat exchanger (3) for heating and the first indoor heat exchanger (12).

If the cooling load is equal to the heating load, the electromotive valve (36) of the liquid supply pipe (35) is closed. As a result, the same circulating operation of the refrigerant as in the case described above in Embodiment 1 is performed.

If there is no heating load, the upstream electromotive valve (13*a*) is closed completely. In this case, the use-side refrigerant circulates only between the heat releasing element (5B) of the heat exchanger (5) for cooling and the second indoor heat exchanger (14) and is prevented from flowing into the first indoor heat exchanger (12). That is, the circulating operation of the refrigerant is such that only the cooling capability is obtainable from the second indoor heat exchanger (14).

To implement such an operating action, the evaporated heat-source-side refrigerant leaves residual heat in the primary refrigerant circuit (1). Therefore, an air heat exchanger or the like for releasing the residual heat becomes necessary.

Embodiment 6

The present embodiment has the components of each of Embodiments 4 and 5 in combination.

Figure 8:
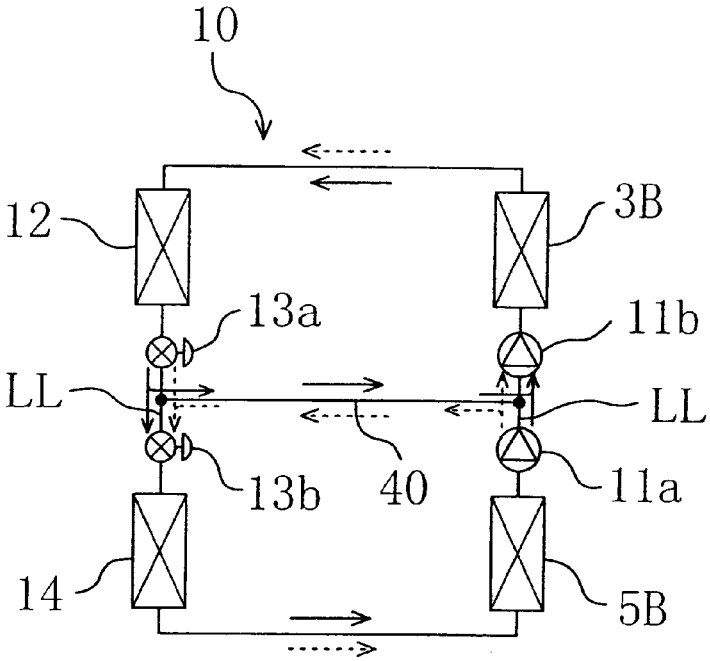
FIG. 8 is a refrigerant piping diagram of Embodiment 6.

As shown in FIG. 8, the secondary refrigerant circuit (10) of the present embodiment has two electromotive valves (13*a*, 13*b*) in the liquid pipe (LL) between the first and second indoor heat exchangers (12) and (14).

In addition, there are two pumps (11*a*, 11*b*) provided in the liquid pipe (LL) between the heat absorbing element (3B) of the heat exchanger (3) for heating and the heat releasing element (5B) of the heat exchanger (5) for cooling. The operating frequencies of the pumps (11*a*, 11*b*) are variable and the amount of refrigerant ejected therefrom per unit time is variable.

In addition, capability adjusting means for adjusting the respective transfer abilities of the pumps (11*a*, 11*b*) is provided in the controller of the present apparatus, though it is not depicted.

Moreover, a liquid passage pipe (40) as a liquid passage pipe is connected between the liquid pipe (LL) located between the electromotive valves (13*a*, 13*b*) and the liquid pipe (LL) located between the pumps (11*a*, 11*b*).

In the structure, the upstream electromotive valve (13*a*) is opened and the opening rate of the downstream valve (13*b*) is reduced in the heating rich state. On the other hand, the operating frequency of the downstream pump (11*b*) is adjusted to be higher than the operating frequency of the upstream pump (11*a*).

Consequently, a part of the use-side refrigerant which has been ejected from the upstream and downstream pumps (11*a* and 11*b*) and passed through the heat absorbing element (3B) of the heat exchanger (3) for heating, the first indoor heat exchanger (12), and the upstream electromotive valve (13*a*) flows into the second indoor heat exchanger (14) to contribute to the cooling of the indoor air, flows out into the low-pressure gas pipe (GL), and returns to the suction side of the upstream pump (11*a*) via the heat releasing element (5B) of the heat exchanger (5) for cooling, as indicated by the solid arrows in FIG. 8.

The remaining part of the use-side refrigerant flows through the liquid passage pipe (40) and returns to the suction side of the downstream pump (11*b*) without undergoing a phase change. In short, the use-side refrigerant flowing through the liquid passage pipe (40) bypasses the second indoor heat exchanger (14).

As for the other actions, they are the same as in the case described above in Embodiment 1.

If there is no cooling load, the downstream electromotive valve (13*b*) is closed completely, while the upstream pump (11*a*) is halted. In this case, the use-side refrigerant circulates only between the heat absorbing element (3B) of the heat exchanger (3) for heating and the first indoor heat exchanger (12) and is prevented from flowing into the second indoor heat exchanger (14).

In the cooling rich state, on the other hand, the downstream electromotive valve (13*b*) of the liquid pipe (LL) is opened and the opening rate of the upstream electromotive valve (13*a*) is reduced. The operating frequency of the upstream pump (11*a*) is adjusted to be higher than the operating frequency of the downstream pump (11*b*).

As a result, a part of the use-side refrigerant ejected from the upstream pump (11*a*) passes through the downstream pump (11*b*), flows into the heat absorbing element (3B) of the heat exchanger (3) for heating where it absorbs heat from the heat-source-side refrigerant to evaporate, and then flows out into the high-pressure gas pipe (GH), as indicated by the broken arrows in FIG. 8. Thereafter, the use-side refrigerant flows through the first indoor heat exchanger (12) to contribute to the heating of the indoor air.

The remaining part of the refrigerant flows through the liquid passage pipe (40), merges with the use-side refrigerant that has passed through the first indoor heat exchanger (12), and flows into the second indoor heat exchanger (14) through the downstream electromotive valve (13*b*).

As for the other actions, they are the same as in the case described above in Embodiment 1.

If there is no heating load, the upstream electromotive valve (13*a*) is closed completely and the downstream pump (11*b*) is halted. In this case, the use-side refrigerant circulates only between the heat releasing element (5B) of the heat exchanger (5) for cooling and the second indoor heat exchanger (14) and therefore is prevented from flowing into the first indoor heat exchanger (12).

Thus, the present embodiment enables the circulating operation of the use-side refrigerant responsive to each of the heating rich state and the cooling rich state. To implement such an operating action, the heat-source-side refrigerant incurs an insufficient amount of heat or excess heat in the primary refrigerant circuit (1), so that an air heat exchanger for eliminating such drawbacks is needed.

In the present embodiment, it is also possible to provide an electromotive valve in the liquid passage pipe (40) such that the amount of refrigerant flowing through the liquid passage pipe (40) is adjustable.

First Variation of Embodiment 6

Figure 9:
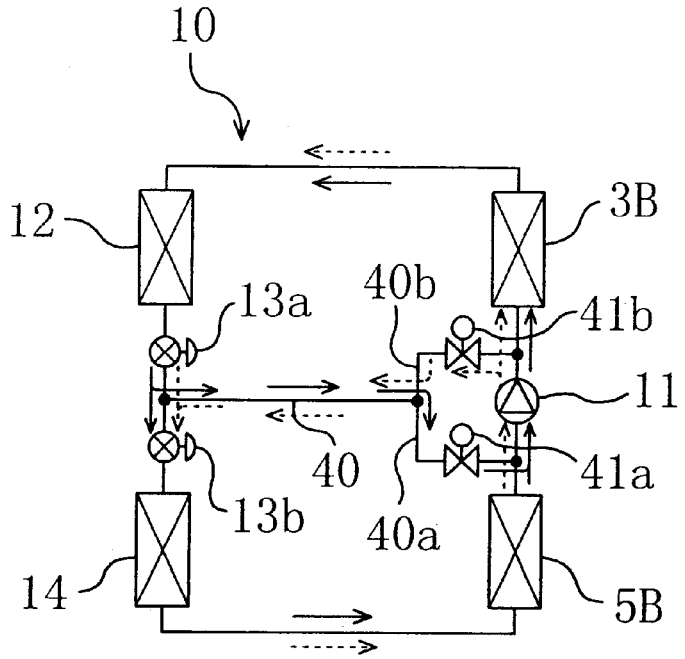
FIG. 9 is a refrigerant piping diagram of a first variation of Embodiment 6.

A description will be given to a first variation of Embodiment 6 described above. As shown in FIG. 9, the present variation uses only one pump (11).

The liquid passage pipe (40) has one end (to be connected to the pump) divided into two branch pipes which are a first branch pipe (40*a*) connected to the suction side of the pump (11) and a second branch pipe (40*b*) connected to the ejection side of the pump (11) . The branch pipes (40*a*, 40*b*) are provided with respective electromagnetic valves (41*a*, 41*b*) as first and second flow rate control valves.

Open/close control means for controlling the opening/closing actions of the electromagnetic valves (41*a*, 41*b*) are provided in the controller of the present apparatus, though it is not depicted.

In the structure, the upstream electromotive valve (13*a*) of the liquid pipe (LL) is opened and the opening rate of the downstream electromotive valve (13*b*) is reduced in the heating rich state. On the other hand, the electromagnetic valve (41*a*) of the first branch pipe (40*a*) is opened and the electromagnetic valve (41*b*) of the second branch pipe (40*b*) is closed. This allows the same circulating operation of the refrigerant as in the heating rich state in Embodiment 6 described above to be performed (see the solid arrows shown in FIG. 9). As the cooling load is smaller, the opening rate of the downstream electromotive valve (13*b*) is reduced and the amount of liquid refrigerant in the liquid passage pipe (40) is increased.

In the cooling rich state, on the other hand, the downstream electromotive valve (13*b*) of the liquid pipe (LL) is opened and the opening rate of the upstream electromotive valve (13*a*) is reduced. On the other hand, the electromagnetic valve (41*a*) of the first branch pipe (40*a*) is closed and the electromagnetic valve (41*b*) of the second branch pipe (40*b*) is opened. This allows the same circulating operation of the refrigerant as in the cooling rich state in Embodiment 6 described above to be performed (see the broken arrows shown in FIG. 9). As the heating load is smaller, the opening rate of the upstream electromotive valve (13*a*) is reduced and the amount of liquid refrigerant in the liquid passage pipe (40) is increased.

Thus, the present embodiment enables the circulating operation of the use-side refrigerant responsive to each of the heating rich state and the cooling rich state by using only one pump (11).

Second Variation of Embodiment 6

Figure 10:
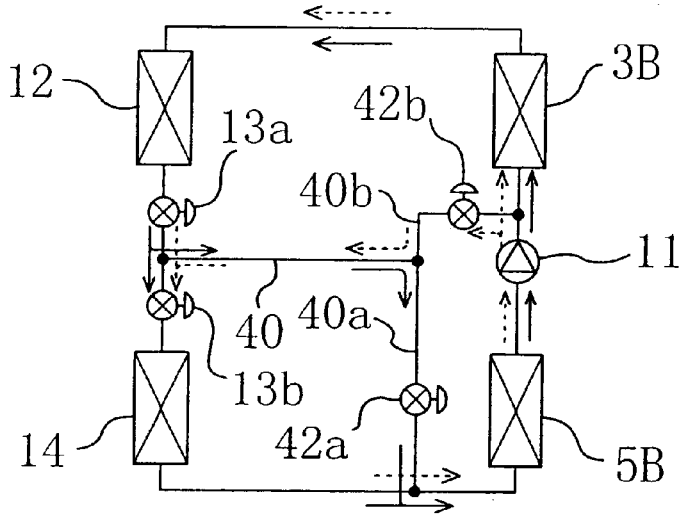
FIG. 10 is a refrigerant piping diagram of a second variation of Embodiment 6.

A description will be given to a second variation of Embodiment 6 described above. As shown in FIG. 10, the present variation also uses only one pump (11).

The second branch pipe (40*b*) of the liquid passage pipe (40) is connected to the ejection side of the pump (11), while the first branch pipe (40*a*) is connected to the upstream side of the heat releasing element (5B) of the heat exchanger (5) for cooling. The branch pipes (40*a*, 40*b*) are provided with respective electromotive valves (42*a*, 42*b*) as flow rate control valves.

Open/close control means for controlling the opening/closing actions of the electromagnetic valves (42*a*, 42*b*) are provided in the controller of the present apparatus, though it is not depicted.

The structure allows the circulating operation of the use-side refrigerant responsive to the heating rich state and the cooling rich state to be performed by adjusting the opening rates of the valves, similarly to the first variation described above. As the cooling load is smaller, the opening rate of the electromotive valve (42*b*) of the second branch pipe (40*b*) is reduced and the amount of liquid refrigerant in the first branch pipe (40*a*) is increased. On the other hand, the opening rate of the electromotive valve (42*a* ) of the first branch pipe (40*a*) is reduced and the amount of liquid refrigerant in the second branch pipe (40*b*) is increased as the heating load is smaller. In FIG. 10 also, the circulating operation of the refrigerant in the heating rich state is indicated by the solid arrows and the circulating operation of the refrigerant in the cooling rich state is indicated by the broken arrows.

The structure according to the present embodiment ensures liquefaction of the use-side refrigerant returning to the pump (11) by means of the heat exchanger (5) for cooling in the operating action in the heating rich state. As a result, there can be circumvented the case where the refrigerant in a gas phase returns to the pump (11) and hinders the driving of the pump (11).

Embodiment 7

A description will be given to Embodiment 7. The present embodiment has a plurality of outdoor units (A1, A2).

Figure 11:
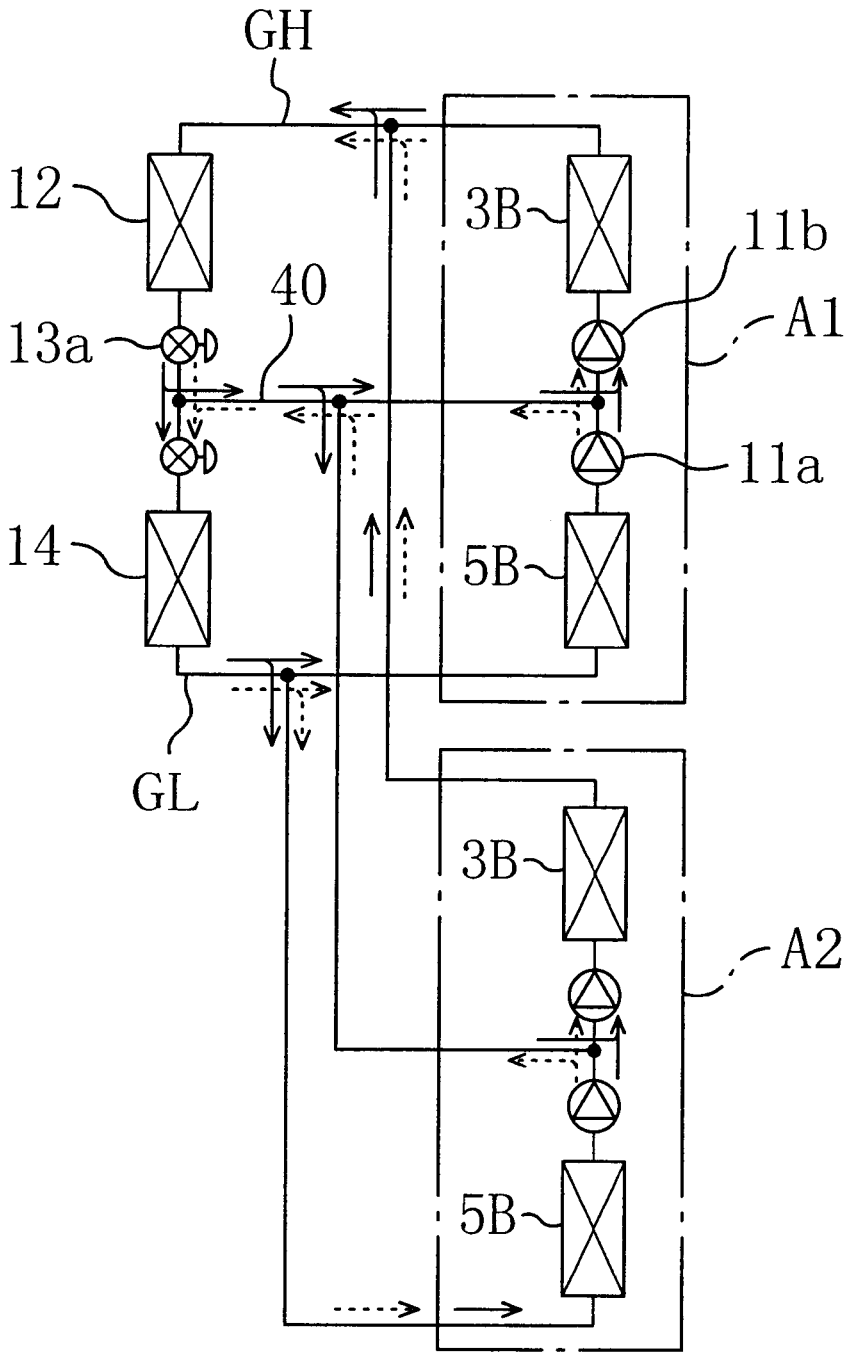
FIG. 11 is a refrigerant piping diagram of Embodiment 7.

As shown in FIG. 11, the present embodiment has been achieved by connecting two outdoor units (A1, A2) in parallel in the circuit structure of Embodiment 6 described above. Specifically, each of the high-pressure gas pipe (GH) and the low-pressure gas pipe (GL) is divided into branch pipes which are connected to the respective heat absorbing elements (3B) of the heat exchangers (3) for heating and to the respective heat releasing elements (5B) of the heat exchangers (5) for cooling in the outdoor units (A1, A2).

The outdoor units (A1, A2) have the same structures as those used in Embodiment 6 described above. The operating actions of the present embodiment are also the same as those of Embodiment 6 so that the heating and cooling capabilities are adjusted by adjusting the opening rates of the individual valves (13*a*, 13*b*) and the operating frequencies of the pumps (11*a*, 11*b*).

In the structure, the adjustable range of the heating and cooling capabilities can be expanded by adjusting the respective capabilities of the indoor units (A1, A2).

Embodiment 8

Next, Embodiment 8 will be described. The present embodiment also has a plurality of outdoor units (A1, A2).

Figure 12:
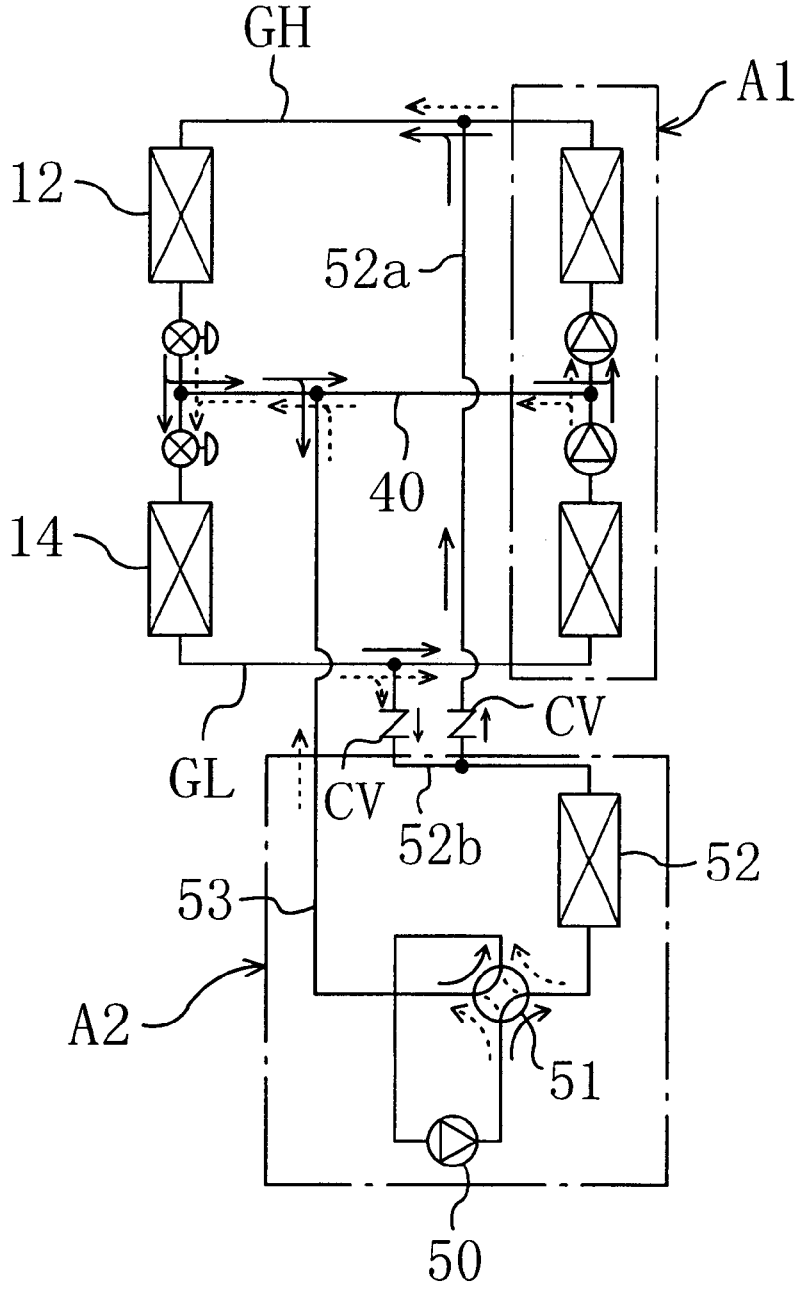
FIG. 12 is a refrigerant piping diagram of Embodiment 8.

As shown in FIG. 12, of the two outdoor units (A1, A2) of the present embodiment, the first outdoor unit (A1) has the same structure as used in each of the foregoing embodiments. On the other hand, the second outdoor unit (A2) comprises a pump (50), a four-way switch valve (51) as flow path switching means, and an air heat exchanger (52) to constitute a closed circuit in conjunction with the indoor heat exchangers (12, 14). Briefly, the gas side of the air heat exchanger (52) is divided into branch pipes (52*a*, 52*b*) such that the first branch pipe (52*a*) is connected to the high-pressure gas pipe (GH) and the second branch pipe (52*b*) is connected to the low-pressure gas pipe (GL). A check valve (CV) for permitting only a flow of the use-side refrigerant directed to the high-pressure gas pipe (GH) is provided in the first branch pipe (52*a*). A check valve (CV) for permitting only a flow of the use-side refrigerant directed to the air heat exchanger (52*b*) is provided in the second branch pipe (52*b*).

There is also provided a connecting pipe (53) for providing a connection between the liquid passage pipe (40) and the second outdoor unit (A2).

The liquid side of the air heat exchanger (52) and the connecting pipe (53) are connected to the four-way switch valve (51). In addition, switch control means for controlling the switching of the four-way switching means (51) is provided in the controller of the present apparatus, though it is not depicted. The four-way switch valve (51) is switched by the control operation of the switch control means. Specifically, the four-way switch valve (51) is switchable between the state in which the ejection side of the pump (50) is connected to the air heat exchanger (52) and the suction side thereof is connected to the connecting pipe (53) and the state in which the ejection side of the pump (50) is connected to the connecting pipe (53) and the suction side thereof is connected to the air heat exchanger (52).

A description will be given to the operating actions of the second outdoor unit (A2).

In the heating rich state, the four-way switch valve (51) is switched to the side indicated by the solid arrows in the drawing so that a heat-release assisting action is performed. The use-side refrigerant in a liquid phase ejected from the pump (50) exchanges heat with, e.g., the outside air in the air heat exchanger (52) to evaporate, as indicated by the arrows in FIG. 12, flows into the high-pressure gas pipe (GH), and merges with the use-side refrigerant flowing out from the heat absorbing element (3B) of the heat exchanger (3) for heating. The useside refrigerant contributes to indoor heating in the first indoor heat exchanger (12). Of the use-side refrigerant that has passed through the first indoor heat exchanger (12), the portion which flows through the liquid passage pipe (40) is partially recovered by the suction side of the pump (50) after passing through the connecting pipe (53) and the four-way switch valve (51). Such circulating operation of the refrigerant is performed continuously.

In the cooling rich state, on the other hand, the four-way switch valve (51) is switched to the side indicated by the broken arrows in the drawing so that a heat-absorption assisting action is performed. The use-side refrigerant in a liquid phase ejected from the pump (50) passes through the connecting pipe (53) and merges with the refrigerant in the liquid passage pipe (40), as indicated by the broken arrows in FIG. 12. The use-side refrigerant contributes to cooling in the second indoor heat exchanger (14) and flows out into the low-pressure gas pipe (GL). A part of the use-side refrigerant flowing through the low-pressure gas pipe (GL) passes through the second branch pipe (52*b*), the air heat exchanger (52), and the four-way switch valve (51) to be recovered by the suction side of the pump (50). Such circulating operation of the refrigerant is performed continuously.

Thus, the present embodiment has such a structure as to allow the use of the secondary refrigerant system and a single-stage refrigerant circuit in combination.

Circuit Structure Which Renders Each Indoor unit Switchable Between Cooling and Heating Operations Each of the following Embodiments 9 to 11 has adopted a so-called cooling/heating free circuit structure which renders each of the indoor units (B, C) independently switchable between cooling and heating operations.

Embodiment 9

The present embodiment is obtained by rendering each of the indoor units (B, C) switchable between cooling and heating operations in the circuit structure of Embodiment 1 described above.

Figure 13:
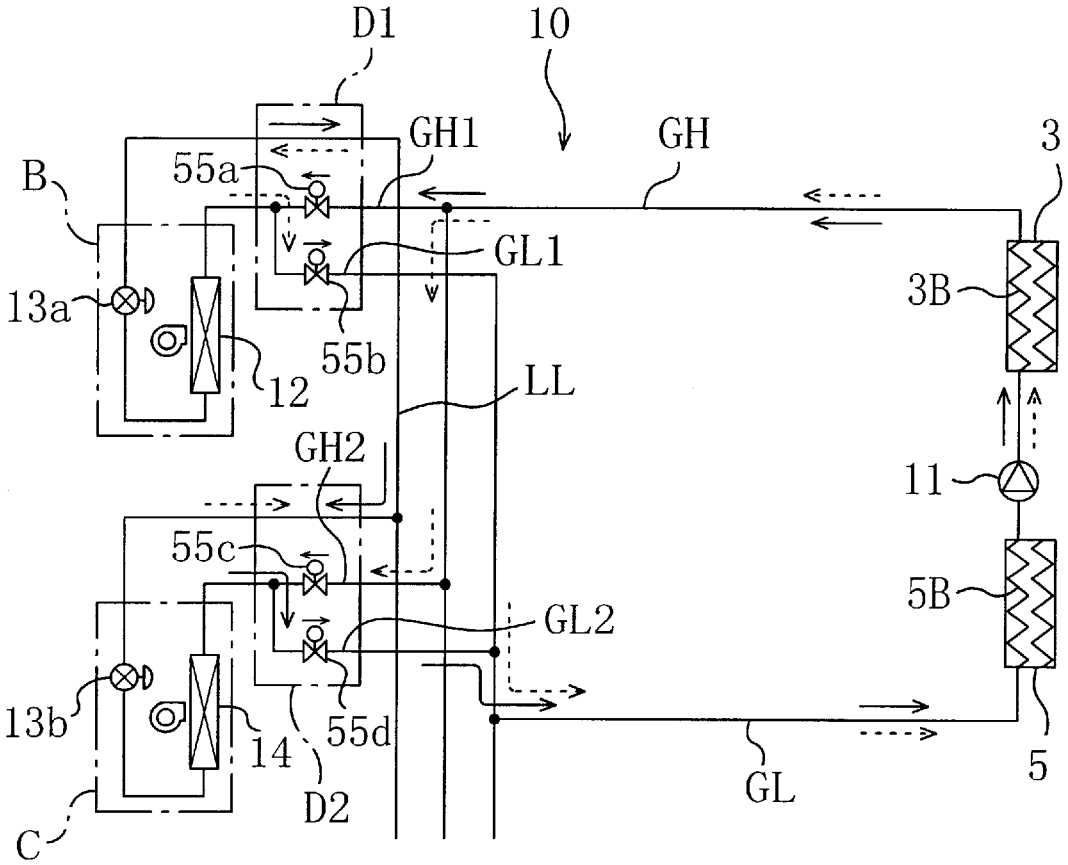
FIG. 13 is a refrigerant piping diagram of Embodiment 9.

As shown in FIG. 13, the secondary refrigerant circuit (10) of the present embodiment has first and second switching units (D1, D2) as switching means between the high-pressure and low-pressure gas pipes (GH) and (GL) and the indoor units (B, C), respectively. The indoor units (B, C) have the same structures. That is, the indoor units (B, C) contain respective indoor heat exchangers (12, 14) and electromotive valves (13*a*, 13*b*) are connected to the respective liquid sides of the indoor heat exchangers (12, 14).

Each of the high-pressure and low-pressure gas pipes (GH) and (GL) is branched. The branch pipes (GH1, GH2) of the high-pressure gas pipe (GH) and the branch pipes (GL1, GL2) of the low-pressure gas pipe (GL) are connected inside the respective switching units (D1, D2). Electromagnetic valves (55*a*, 55*b*, 55*c*, 55*d*) are provided in the respective branch pipes (GH1, GL1, GH2, GL2). Specifically, the high-pressure electromagnetic valves (55*a*, 55*c*) are provided in the respective branch pipes (GH1, GH2) of the high-pressure gas pipe in the respective switching units (D1, D2) and the low-pressure electromagnetic valves (55*b*, 55*d*) are provided in the branch pipes (GL1, GL2) of the high-pressure gas pipe in the respective switching units (D1, D2). In addition, switching control means for controlling the opening and closing operations of each of the electromagnetic valves (55*a*, 55*b*, 55*c*, 55*d*) is provided in the controller of the present apparatus, though it is not depicted.

The respective electromotive valves (13*a*, 13*b*) of the indoor units (B, C) are connected to each other by the liquid pipe (LL).

If heating operation is performed in the first indoor unit (B) and cooling operation is performed in the second indoor unit (C) in the structure, the high-pressure electromagnetic valve (55*a*) is opened and the low-pressure electromagnetic valve (55*b*) is closed in the first switching unit (D1), while the high-pressure electromagnetic valve (55*c*) is closed and the low-pressure electromagnetic valve (55*d*) is opened in the second switching unit (D2).

As a result, the use-side refrigerant in a liquid phase ejected from the pump (11) exchanges heat with the heat-source-side refrigerant in the heat exchanger (3) for heating to evaporate, as indicated by the solid arrows in FIG. 13. The evaporated use-side refrigerant in a gas phase passes through the high-pressure gas pipe (GH) and the first switching unit (D1) and flows into the first indoor unit (B). In the first indoor unit (B), the use-side refrigerant exchanges heat with the indoor air in the first indoor heat exchanger (12), thereby heating and condensing the indoor air.

Thereafter, the use-side refrigerant in a liquid phase flows through the liquid pipe (LL), passes through the first and second switching units (D1 and D2) and flows into the second indoor unit (C). The use-side refrigerant is reduced in pressure by the electromotive valve (13*c*) and exchanges heat with the indoor air in the second indoor heat exchanger (14), thereby cooling the indoor air and evaporating. After that, the use-side refrigerant in a gas phase passes through the second switching unit (D2) and the low-pressure gas pipe (GL) and then exchanges heat with the heat-source-side refrigerant in the heat exchanger (5) for cooling to be condensed and recovered by the pump (11). Such circulating operation of the use-side refrigerant is performed continuously in the secondary refrigerant circuit (10), whereby heating and cooling operations are performed in the first and second indoor units (B) and (C), respectively.

Conversely, if cooling operation is performed in the first indoor unit (B) and heating operation is performed in the second indoor unit (C), the high-pressure electromagnetic valve (55*a*) is closed and the low-pressure electromagnetic valve (55*b*) is opened in the first switching unit (D1) On the other hand, the high-pressure electromagnetic valve (55*c*) is opened and the low-pressure electromagnetic valve (55*d*) is closed in the second switching unit (D2).

As a result, the use-side refrigerant in a liquid phase that has been ejected from the pump (11) flows sequentially through the heat exchanger (3) for heating, the high-pressure gas pipe (GH), and the second switching unit (D2) to flow into the second indoor unit (C), as indicated by the broken arrows in FIG. 13. In the second indoor unit (C), the use-side refrigerant exchanges heat with the indoor unit in the second indoor heat exchanger (14), thereby heating and condensing the indoor air. Thereafter, the use-side refrigerant in a liquid phase flows through the liquid pipe (LL), passes through the second and first switching units (D2) and (D1), and flows into the first indoor unit (B). In the first indoor unit (B), the use-side refrigerant passes through the electromotive valve (13*a*) and exchanges heat with the indoor air in the first indoor heat exchanger (12), thereby cooling the indoor air and evaporating.

Thereafter, the use-side refrigerant in a gas phase flows sequentially through the first switching unit (D1), the low-pressure gas pipe (GL), and the heat exchanger (5) for cooling to be recovered by the pump (11). Such circulating operation of the use-side refrigerant is performed continuously in the secondary refrigerant circuit (10), whereby cooling and heating operations are performed in the first and second indoor units (B) and (C), respectively.

Thus, according to the present embodiment, operating actions in the respective indoor units (B, C) can be switched arbitrarily through the switching operations of the electromagnetic valves (55*a*, 55*b*, 55*c*, 55*d*) in the switching units D1, D2.

Embodiment 10

The present embodiment is obtained by rendering each of the indoor units (B, C) switchable between cooling and heating operations in the circuit structure (FIG. 3) of Embodiment 2 described above. A description will be given only to portions different from Embodiment 9 described above.

Figure 14:
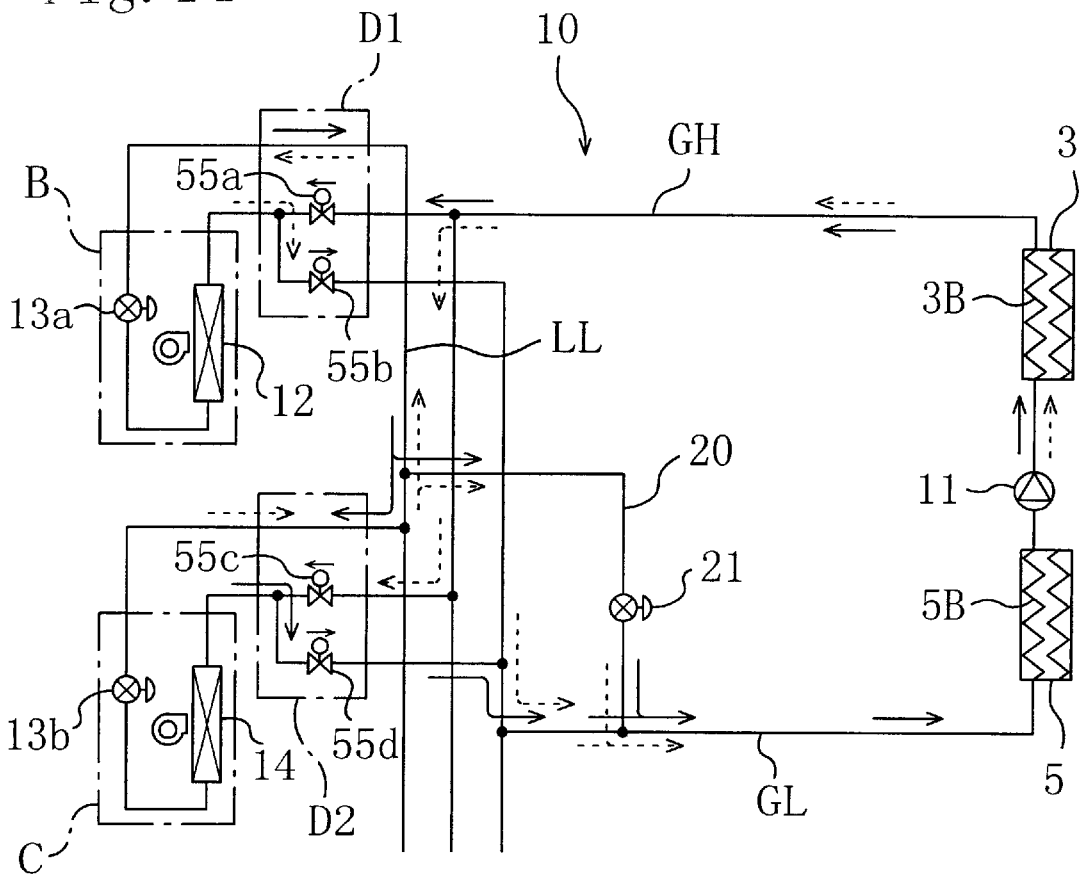
FIG. 14 is a refrigerant piping diagram of Embodiment 10.

As shown in FIG. 14, the secondary refrigerant circuit (10) of the air conditioner in the present embodiment is provided with a bypass pipe (20) for providing a connection between the liquid pipe (LL) between the indoor units (B, C) and the low-pressure gas pipe (GL). An electromotive valve (21) capable of adjusting the flow rate of the refrigerant is provided in the bypass pipe (20).

In the structure, a part of the use-side refrigerant that has passed through the indoor heat exchanger performing a heating action during operation flows into the indoor heat exchanger performing a cooling action, while the remaining part of the use-side refrigerant in a liquid phase or in a liquid-vapor mixed phase flows through the bypass pipe (20). As for the other actions, they are the same as in the case of Embodiment 9 described above (see the arrows in FIG. 14 corresponding to the arrows in FIG. 13).

Thus, in the present embodiment, the heating capability can be adjusted to be higher than the cooling capability by allowing a part of the use-side refrigerant to bypass the indoor heat exchanger performing the cooling action. Hence, the structure of the present embodiment is effective in the heating rich state. Moreover, the amount of the use-side refrigerant bypassing the indoor heat exchanger performing cooling operation can be adjusted by controlling the opening rate of the electromotive valve (21). Accordingly, it becomes possible to provide the refrigerant at a proper flow rate in the indoor heat exchange in accordance with the cooling load.

It is also possible to adopt the structure in which the electromotive valve (21) is not provided in the bypass pipe (20) (corresponding to Embodiment 2 (FIG. 2)).

Embodiment 11

Figure 5:
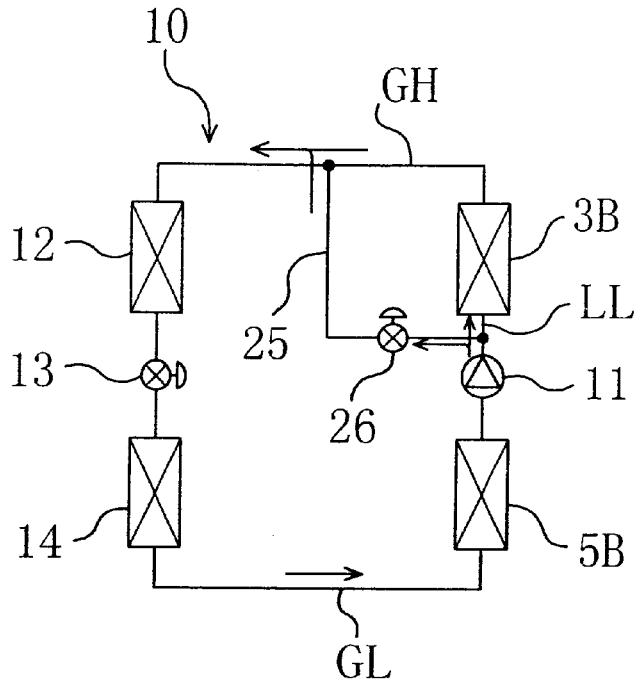
FIG. 5 is a refrigerant piping diagram of a variation of Embodiment 3.

The present embodiment is obtained by rendering each of the indoor units (B, C) switchable between cooling and heating operations in the circuit structure (FIG. 5) of Embodiment 3 described above. A description will also be given only to portions different from Embodiment 9 described above.

Figure 15:
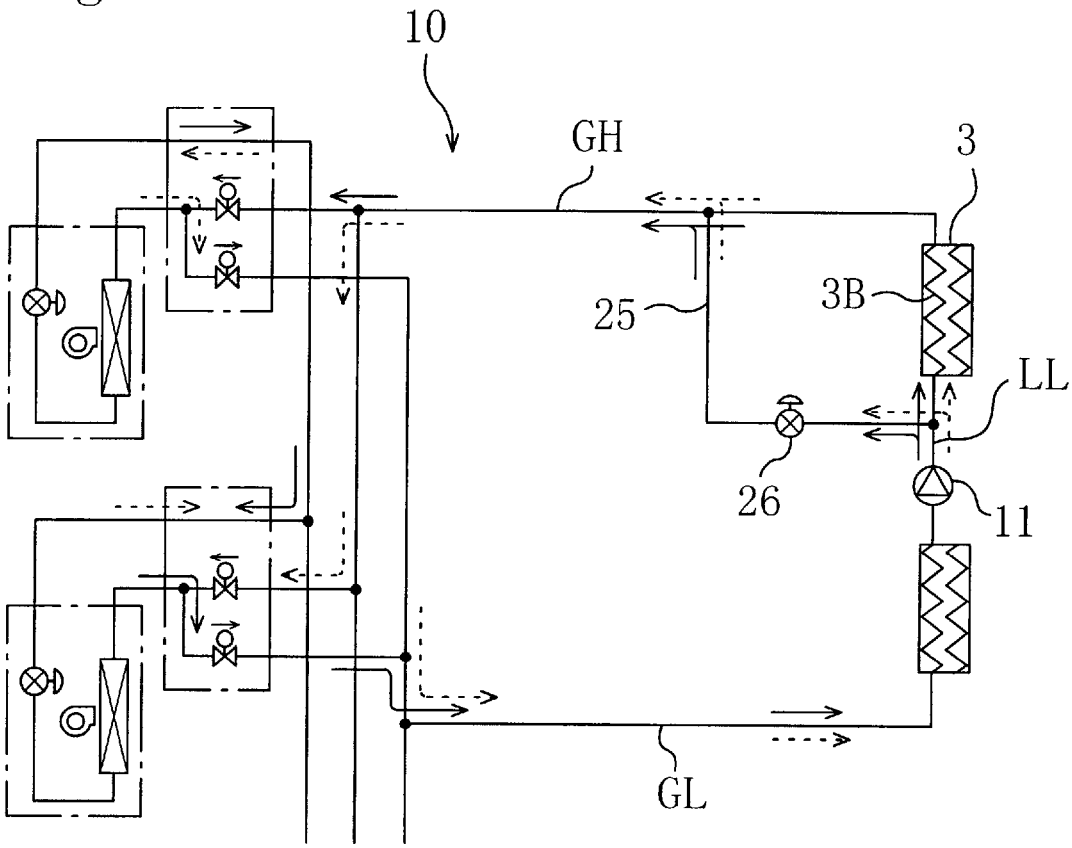
FIG. 15 is a refrigerant piping diagram of Embodiment 11.

As shown in FIG. 15, a bypass pipe (25) for bypassing the heat absorbing element (3B) of the heat exchanger (3) for heating is provided in the secondary refrigerant circuit (10) of the air conditioner in the present embodiment. The bypass pipe (25) has one end connected to the liquid pipe (LL) between the pump (11) and the heat absorbing element (3B) of the heat exchanger (3) for heating and the other end connected to the high-pressure gas pipe (GH). An electromotive valve (26) for enabling the adjustment of the refrigerant flow rate is provided in the bypass pipe (25).

In the structure, a part of the use-side refrigerant in a liquid phase ejected from the pump (11) during operation flows into the heat absorbing element (3B) of the heat exchanger (3) for heating, absorbs heat from the heat-source-side refrigerant to evaporate, and flows into the high-pressure gas pipe (GH). The remaining part of the use-side refrigerant flows through the bypass pipe (25) and merges with the use-side refrigerant in a liquid phase which has passed through the heat absorbing element (3B) of the heat exchanger (3) for heating to flow into the indoor heat exchanger for performing heating operation. As for the other actions, they are the same as in the case of Embodiment 9 described above (see the arrows in FIG. 15 corresponding to the arrows in FIG. 13).

Thus, in the present embodiment, the amount of heat received by the use-side refrigerant from the heat-source-side refrigerant can be adjusted to be smaller than the amount of heat given by the use-side refrigerant to the heat-source-side refrigerant by allowing a part of the use-side refrigerant to bypass the heat absorbing element (3B) of the heat exchanger (3) for heating. Hence, the structure of the present embodiment is effective in the cooling rich state. Moreover, the amount of use-side refrigerant bypassing the heat absorbing element (3B) of the heat exchanger (3) for heating can be adjusted by controlling the opening rate of the electromotive valve (26). Accordingly, it becomes possible to provide the refrigerant at a proper flow rate in the heat absorbing element (3B) of the heat exchanger (3) for heating in accordance with the heating load.

It is also possible to adopt the structure in which the bypass pipe (25) is not provided with the electromotive valve (26) (corresponding to Embodiment 3 (FIG. 4)).

Variations

A description will be given to respective circuit structures obtained by applying the structures of Embodiments 4 to 8 to the circuit structure of Embodiment 9 described above.

Figure 16:
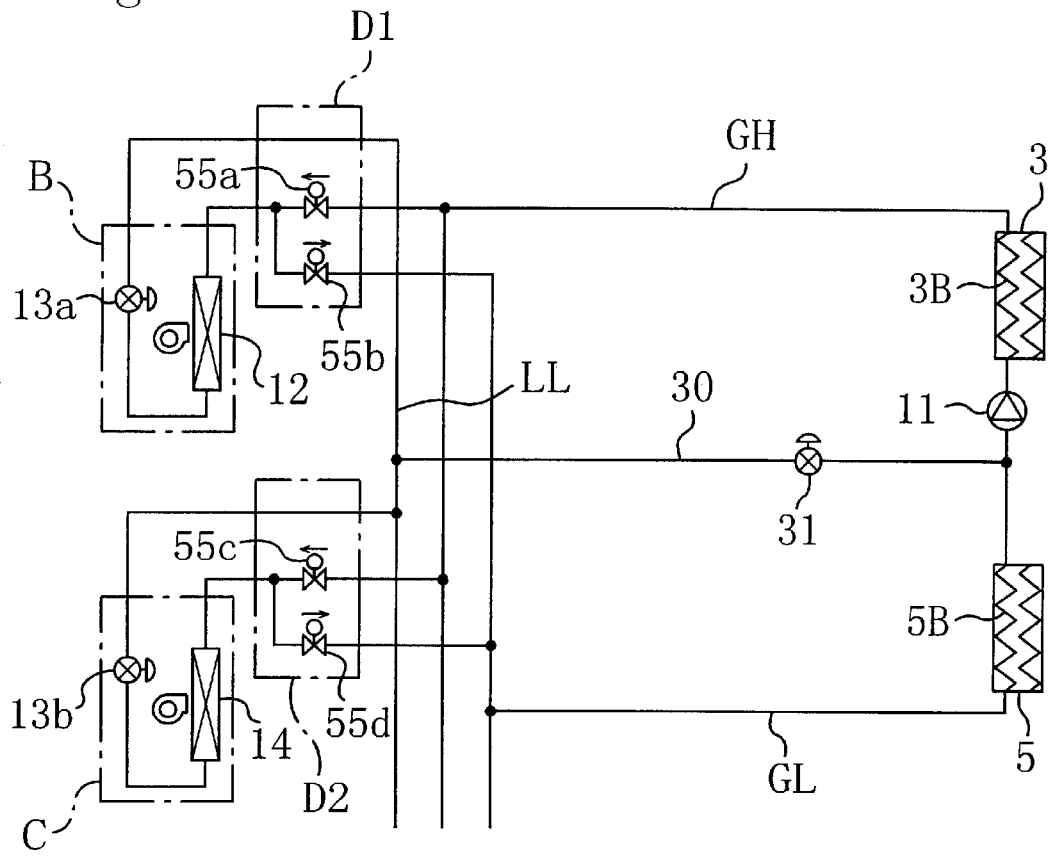
FIG. 16 is a refrigerant piping diagram of Embodiment 9 to which the structure of Embodiment 4 has been applied.

The circuit illustrated in FIG. 16 is obtained by using the liquid return pipe (30) in Embodiment 4 in the circuit structure of Embodiment 9.

Figure 17:
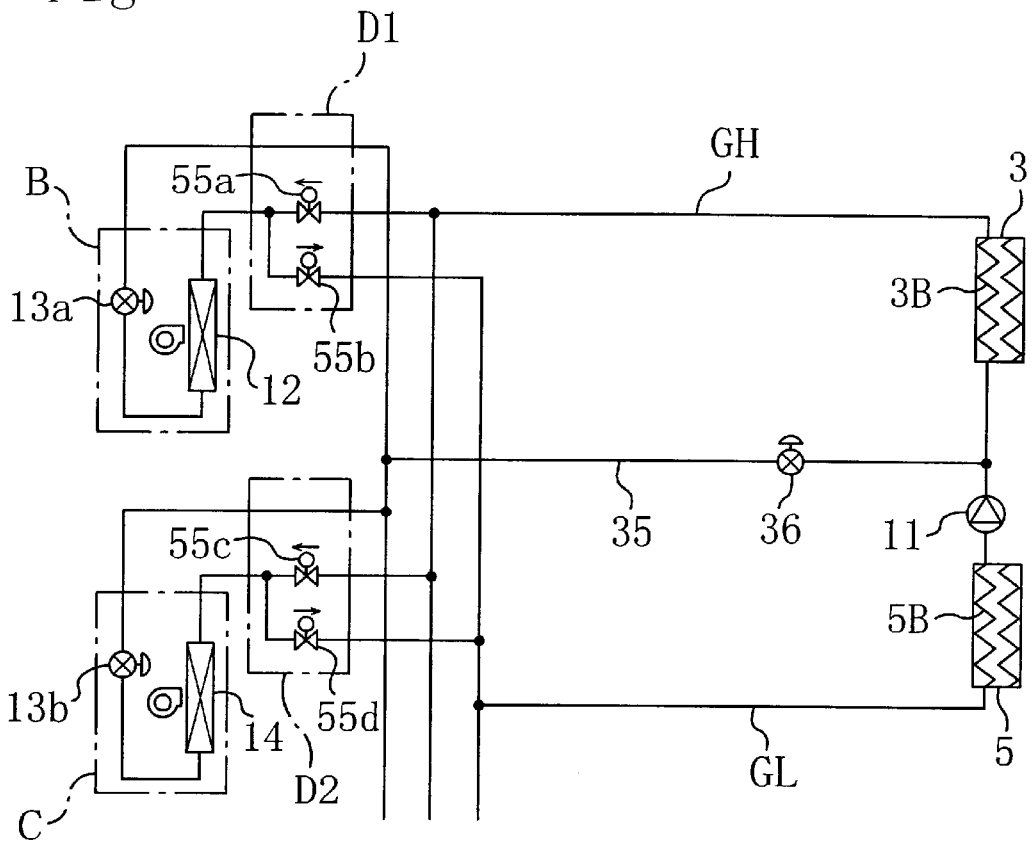
FIG. 17 is a refrigerant piping diagram of Embodiment 9 to which the structure of Embodiment 5 has been applied.

The circuit illustrated in FIG. 17 is obtained by using the liquid return pipe (35) in Embodiment 5 in the circuit structure of Embodiment 9.

Figure 18:
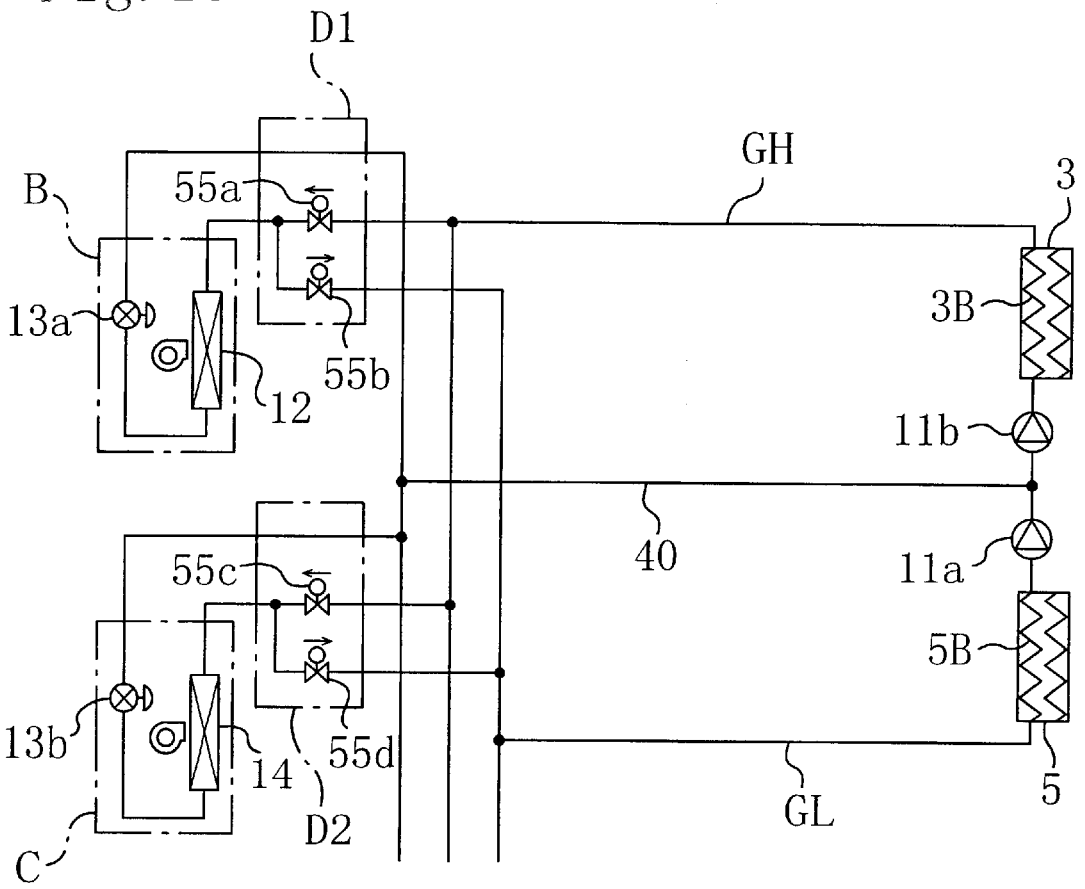
FIG. 18 is a refrigerant piping diagram of Embodiment 9 to which the structure of Embodiment 6 has been applied.

The circuit illustrated in FIG. 18 is obtained by using the liquid passage pipe (40) in Embodiment 6 in the circuit structure of Embodiment 9.

Figure 19:
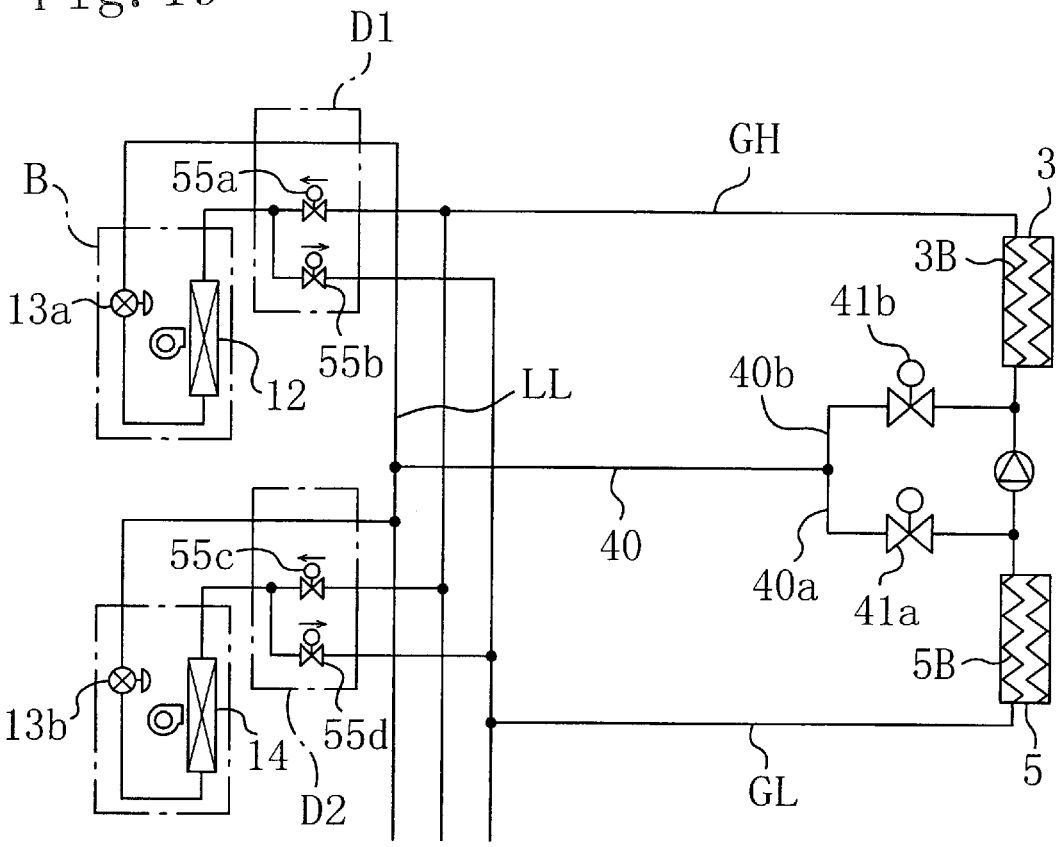
FIG. 19 is a refrigerant piping diagram of Embodiment 9 to which the structure of the first variation of Embodiment 6 has been applied.

The circuit illustrated in FIG. 19 is obtained by using the liquid passage pipe (40) in the first variation of Embodiment 6 in the circuit structure of Embodiment 9.

Figure 20:
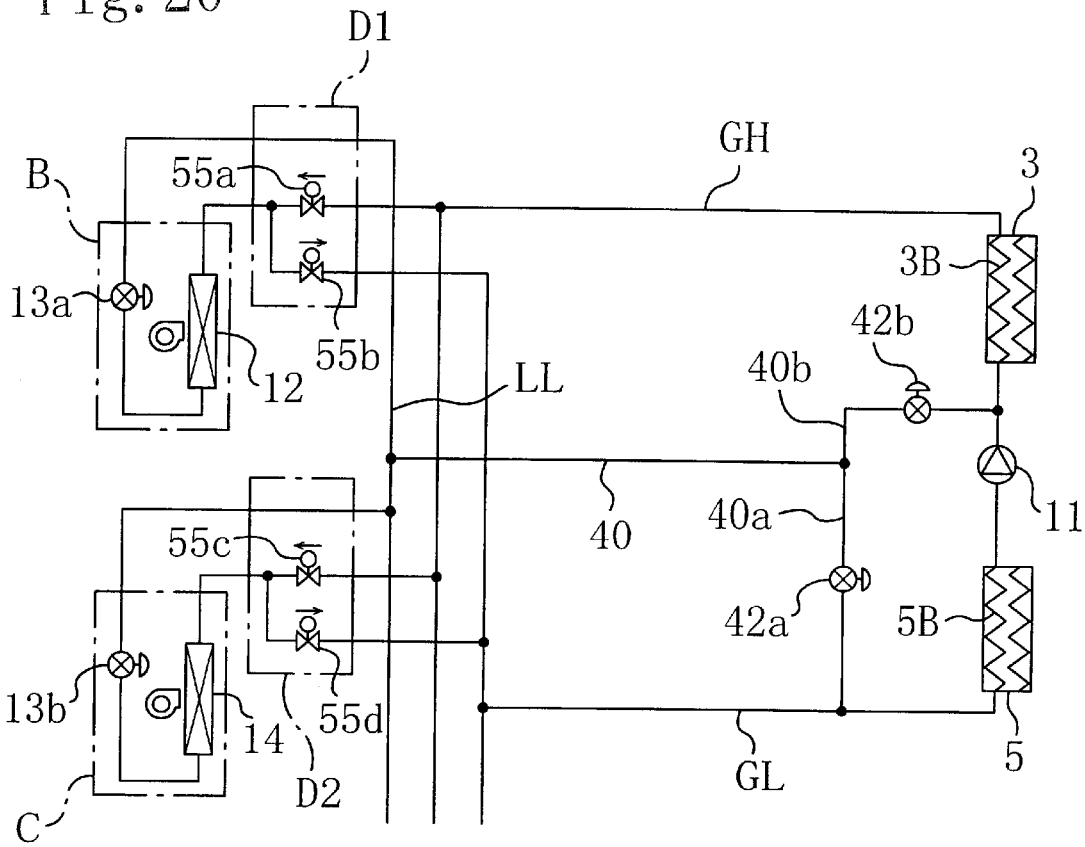
FIG. 20 is a refrigerant piping diagram of Embodiment 9 to which the structure of the second variation of Embodiment 6 has been applied.

The circuit illustrated in FIG. 20 is obtained by using the liquid passage pipe (40) in the second variation of Embodiment 6 in the circuit structure of Embodiment 9.

Figure 21:
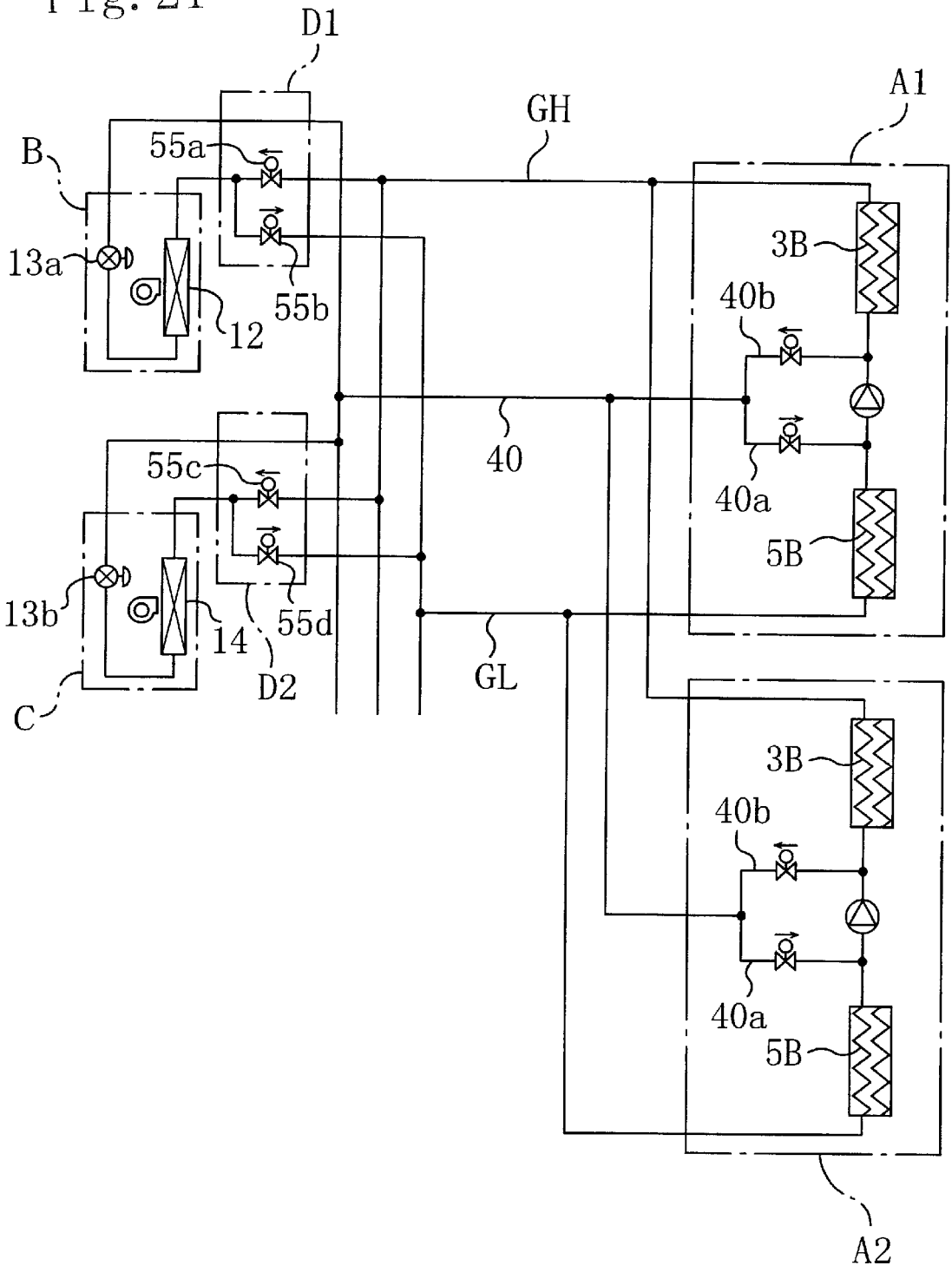
FIG. 21 is a refrigerant piping diagram of Embodiment 9 to which the structure of Embodiment 7 has been applied.

The circuit illustrated in FIG. 21 is obtained by using two outdoor units (A1, A2) as used in Embodiment 7 in the circuit structure of Embodiment 9. In each of the outdoor units A1, A2, the liquid passage pipe (40) is branched and connected to the suction side and ejection side of the pump (11).

Figure 22:
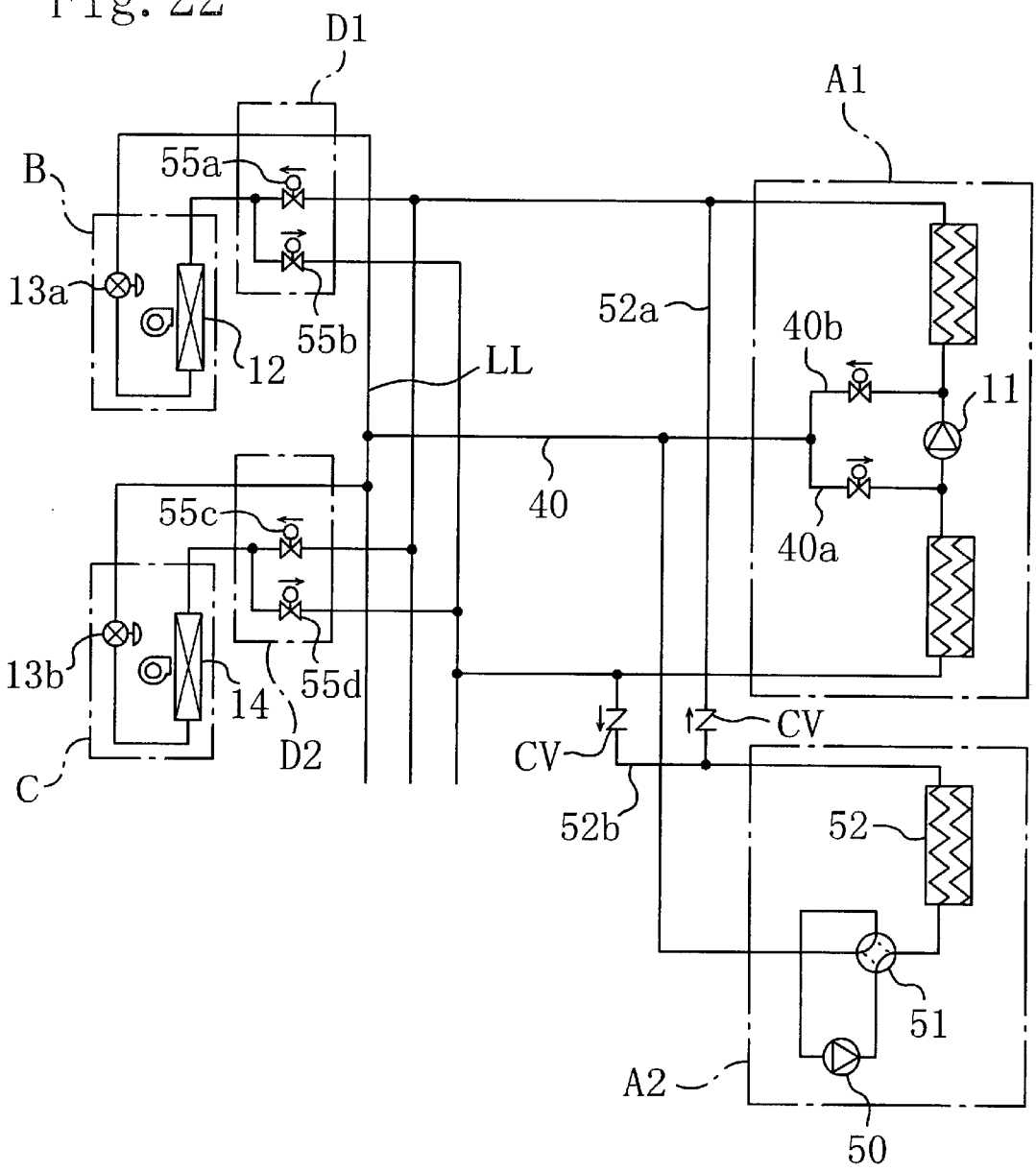
FIG. 22 is a refrigerant piping diagram of Embodiment 9 to which the structure of Embodiment 8 has been applied.

The circuit illustrated in FIG. 22 is obtained by using an outdoor unit (A2) as used in Embodiment 8 in the circuit structure of Embodiment 9. In the circuit also, the liquid passage pipe (40) is branched in the outdoor unit (A1) to be connected to the suction side and ejection side of the pump (11). Moreover, the heat exchanger (52) of the outdoor unit (A2) in the circuit is composed of a heat exchanger in a cascade configuration.

Embodiment 12

The present embodiment obtains a driving force for transferring the use-side refrigerant by utilizing a phase shift accompanying the heating and cooling of the refrigerant in the circuit structure of Embodiment 9 described above.

Figure 23:
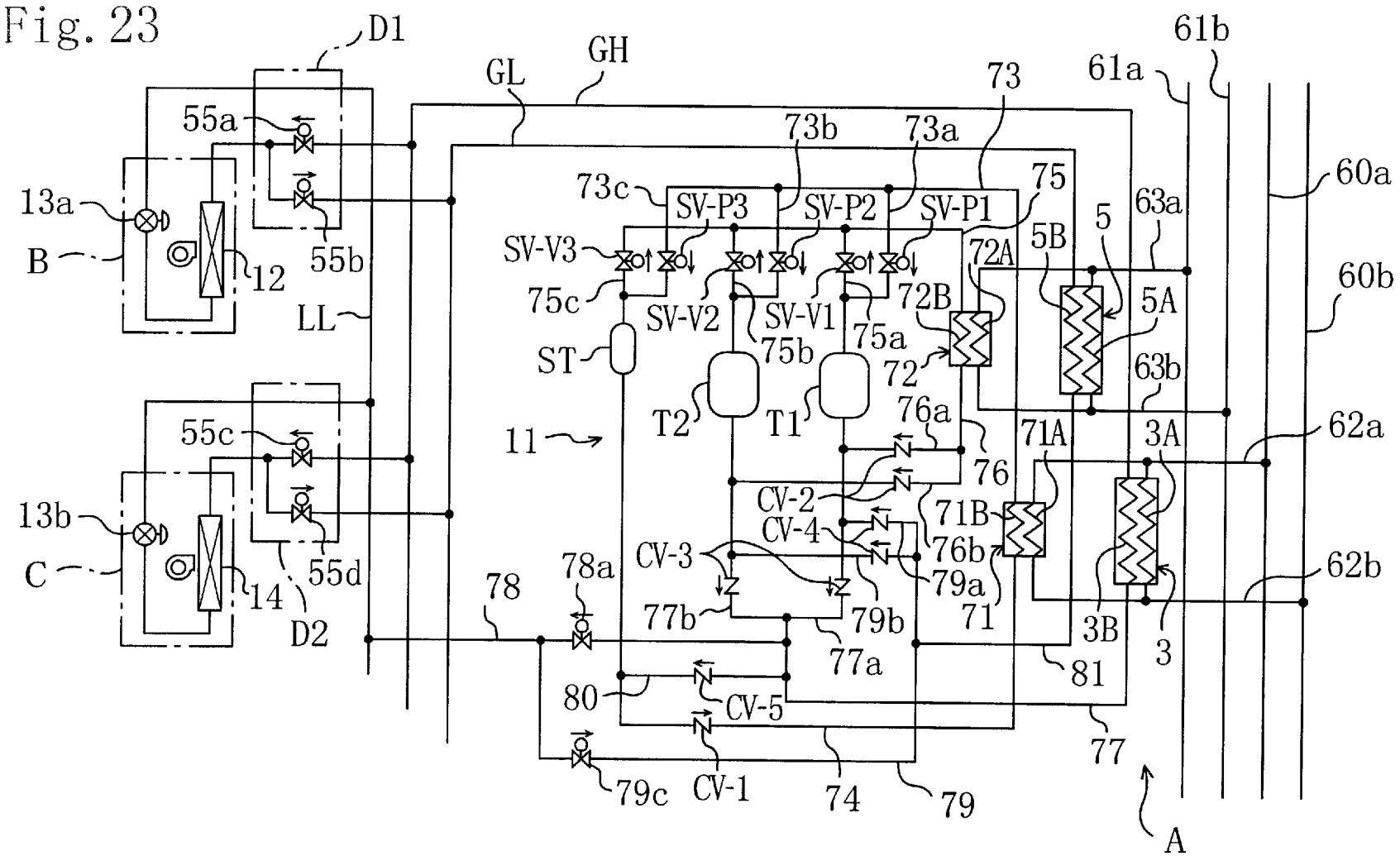
FIG. 23 is a refrigerant piping diagram of Embodiment 12.

As shown in FIG. 23, the present embodiment uses a local cooling/heating system as a heat source. That is, a pair of warm water pipes (60*a*, 60*b*) for supplying and recovering warm water and a pair of cold water pipes (61*a*, 61*b*) for supplying and recovering cold water have been introduced into the outdoor unit A description will be given first to the connection of the warm water pipes (60*a*, 60*b*) to the heat exchanger (3) for heating and the connection of the cold water pipes (61*a*, 61*b*) to the heat exchanger (5) for cooling.

A warm water supply pipe (62*a* ) is connected to the warm water pipe (60*a*) on the warm-water supply side and to the flow-in side of the heat releasing element (3A) of the heat exchanger (3) for heating. A warm water recovery pipe (62*b*) is connected to the warm water pipe (60*b*) on the warm-water recovery side and to the flow-out side of the heat releasing element (3A) of the heat exchanger (3) for heating.

On the other hand, a cold water supply pipe (63*a*) is connected to the cold water supply pipe (61*a*) on the cold-water supply side and to the flow-in side of the heat absorbing element (5A) of the heat exchanger (5) for cooling. A cold water recovery pipe (63*b*) is connected to the cold water pipe (61*b*) on the cold-water recovery side and to the flow-out side of the heat absorbing element (5A) of the heat exchanger (5) for cooling. In short, the use-side refrigerant is evaporated in the heat exchanger (3) for heating by using warm heat from the warm water that has flown in through the warm water pipe (60*a*), while the use-side refrigerant is condensed in the heat exchanger (5) for cooling by using cold heat from the cold water that has flown in through the cold water pipe (61*a*).

The connections of the gas side (upper end portion in FIG. 23) of the heat absorbing element (3B) of the heat exchanger (3) for heating to the individual switching units (D1, D2) are the same as in Embodiment 9 described above. Likewise, the connections of the gas side (upper end portion in FIG. 23) of the heat releasing element (5B) of the heat exchanger (5) for cooling to the individual switching units (D1, D2) are the same as in Embodiment 9 described above.

A description will be given next to a driving force generating circuit (11) constituting the transfer means.

The driving force generating circuit (11) comprises: a circulation heater (71) as pressure increasing means; a circulation cooler (72) as pressure reducing means; first and second main tanks (T1, T2) and a subordinate tank (ST).

More specifically, the circulation heater (71) includes a heat releasing element (71A) and a heat absorbing element (71B) which exchange heat therebetween. The heat releasing element (71A) is connected to the warm water pipe (60*a*) on the warm-water supply side via the warm water supply pipe (62*a*). On the other hand, a gas supply pipe (73) is connected to the upper end portion of the heat absorbing element (71B).

The gas supply pipe (73) is divided into three branch pipes (73*a*–73*c*) which are connected individually to the respective upper end portions of the main tanks (T1, T2) and the subordinate tank (ST). First to third tank pressure increasing electromagnetic valves (SV-P–SV-P3) are provided in the respective branch pipes (73*a*–73*c*).

A liquid recovery pipe (74) has one end connected to the lower end portion of the heat absorbing element (71B) of the circulation heater (71) and the other end connected to the lower end portion of the subordinate tank (ST). A check valve (CV-1) which permits only the flowing out of the refrigerant from the subordinate tank (ST) is provided in the liquid recovery pipe (74).

On the other hand, the circulation cooler (72) includes a heat absorbing element (72A) and a heat releasing element (72B) which exchange heat therebetween. The heat absorbing element (72A) is connected to the cold water pipe (61*a*) on the cold-water supply side via the cold water supply pipe (63*a*). A gas recovery pipe (75) is connected to the upper end portion of the heat releasing element (72B). The gas recovery pipe (75) is divided into three branch pipes (75*a*–75*c*) which are connected to the respective branch pipes (73*a*–73*c*) of the gas supply pipe (73) and thereby connected individually to the respective upper end portions of the main tanks (T1, T2) and the subordinate tank (ST). First to third tank pressure reducing electromagnetic valves (SV-V1–SV-V3) are provided in the respective branch pipes (75*a*–75*c*).

A liquid supply pipe (76) is connected to the lower end portion of the circulation cooler (72). The liquid supply pipe (76) is divided into two branch pipes (76*a*, 76*b*) which are connected individually to the respective lower end portions of the main tanks (T1, T2). Check valves (CV-2) for permitting only refrigerant flows toward the main tanks (T1, T2) are provided in the respective branch pipes (76*a*, 76*b*).

The main tanks (T1, T2) are located at positions lower in level than the circulation cooler (72), while the subordinate tank (ST) is located at a position higher in level than the circulation heater (71).

A liquid pipe (77) is connected to the liquid side (lower end portion in FIG. 23) of the heat absorbing element (3B) of the heat exchanger (3) for heating. The liquid pipe (77) is divided into two branch pipes (77*a*, 77*b*) which are connected to the respective branch pipes (76*a*, 76*b*) of the liquid supply pipe (76) and thereby connected individually to the respective lower end portions of the main tanks (T1, T2). Check valves (CV-3) for permitting only refrigerant flows directed to the heat absorbing element (3B) of the heat exchanger (3) for heating are provided in the respective branch pipes (77*a*, 77*b*).

The liquid pipe (77) and the liquid pipe (LL) are connected to each other via a liquid extrusion pipe (78). An electromagnetic valve (78*a*) is provided in the liquid extrusion pipe (78). A liquid return pipe (79) is further connected to the liquid extrusion pipe (78). The liquid return pipe (79) is divided into two branch pipes (79*a*, 79*b*) which are connected to the respective branch pipes (77*a*, 77*b*) of the liquid pipe (77) and thereby connected individually to the respective lower end portions of the main tanks (T1, T2). An electromagnetic valve (79*c*) is provided in the liquid return pipe (79), while check valves (CV-4) for permitting only refrigerant flows directed to the main tanks (T1, T2) are provided in the respective branch pipes (79*a*, 79*b*).

The liquid pipe (77) connected to the heat absorbing element (3B) of the heat exchanger (3) for heating and the liquid recovery pipe (74) connected to the subordinate tank (ST) are connected to each other by an auxiliary liquid pipe (80). The auxiliary liquid pipe (80) is provided with a check valve (CV-5) for permitting only a refrigerant flow directed to a subordinate tank (ST). Furthermore, a liquid return pipe (81) is connected to the liquid side (lower end portion in FIG. 23) of the heat releasing element (5B) of the heat exchanger (5) for cooling. The downstream end of the liquid return pipe (81) is connected to the liquid return pipe (79).

The foregoing is the structure of the refrigerant circuit of the air conditioner according to the present embodiment.

Operating Actions

Next, operating actions in the present embodiment will be described.

In the case where heating operation is performed in the first indoor unit (B) and cooling operation is performed in the second indoor unit (C), the first switching unit (D1) opens the high-pressure electromagnetic valve (55*a*) and closes the low-pressure electromagnetic valve (55*b*). On the other hand, the second switching unit (D2) closes the high-pressure electromagnetic valve (55*c*) and opens the low-pressure electromagnetic valve (55*d*).

The pressure increasing electromagnetic valve (SV-P1) of the first main tank (T1), the pressure increasing electromagnetic valve (SV-P3) of the subordinate tank (ST), and the pressure reducing electromagnetic valve (SV-V2) of the second main tank (T2) are opened. On the other hand, the pressure increasing electromagnetic valve (SV-P2) of the second main tank (T2), the pressure reducing electromagnetic valve (SV-V1) of the first main tank (T1), and the pressure reducing valve (SV-V3) of the subordinate tank (ST) are closed.

Moreover, the respective electromagnetic valves (78*a*, 79*c*) of the liquid extrusion pipe (78) and the liquid return pipe (79) are closed.

In this state, heat transfer between warm water or cold water and the use-side refrigerant in the circulation heater (71) and circulation heater (72) generates a high pressure with the evaporation of the liquid refrigerant in the heat absorbing element (71B) of the circulation heater (71) and a low pressure with the condensation of the gas refrigerant in the heat releasing element (72B) of the circulation cooler (72). As a result, the pressure inside the first main tank (Ti) and in the subordinate tank (ST) is increased (pressure increasing action), while the pressure inside the second main tank (T2) is reduced (pressure reducing action).

Figure 24:
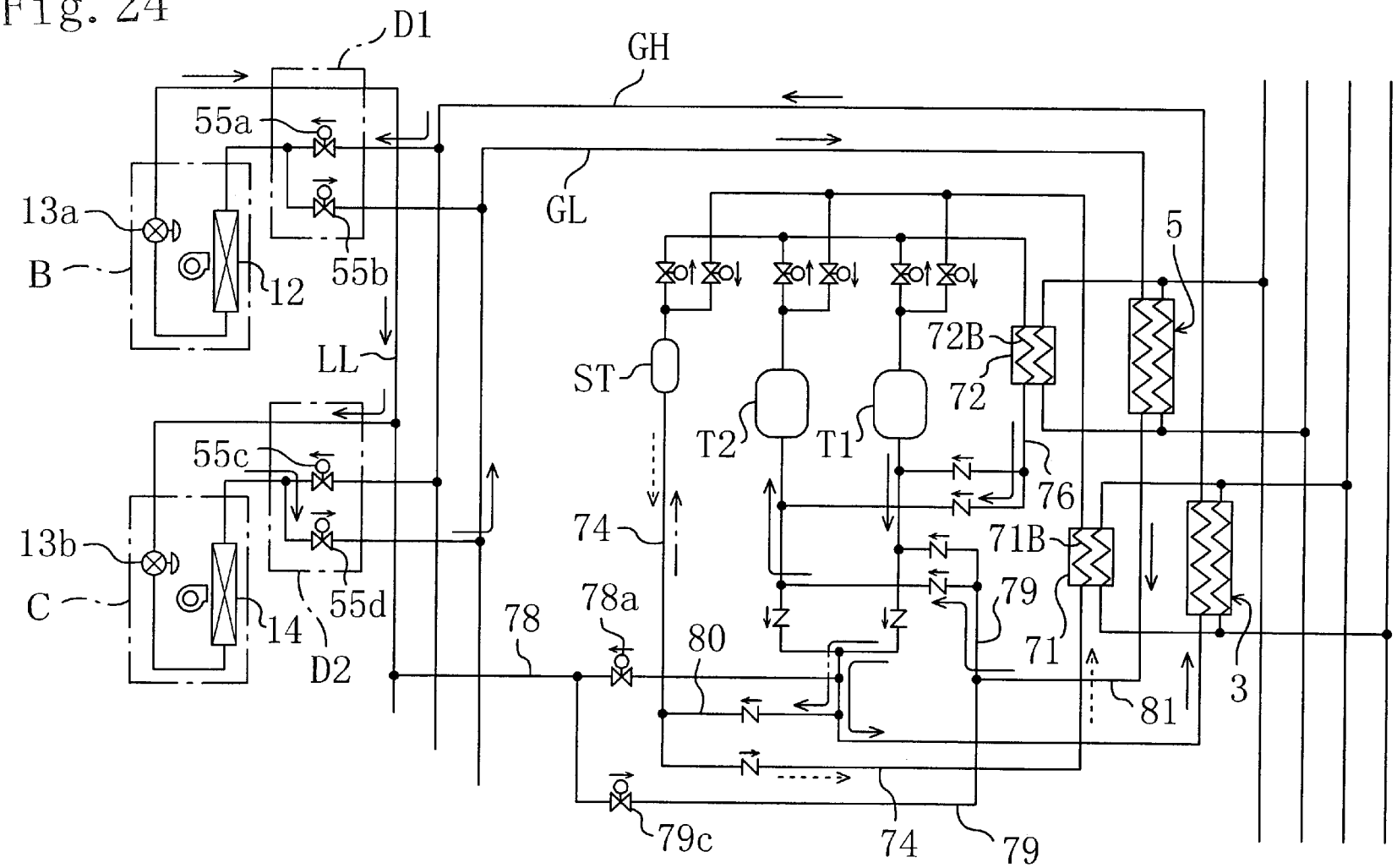
FIG. 24 is a view for illustrating the circulating operation of a refrigerant in Embodiment 12.

Consequently, the liquid refrigerant extruded from the first main tank (T1) is introduced into the heat exchanger (3) for heating where it exchanges heat with warm water and evaporates, as indicated by the solid arrows in FIG. 24. Thereafter, the refrigerant flows sequentially through the first switching unit (D1), the first indoor unit (B), the second switching unit (D2), and the second indoor unit (C) to perform heating operation in the first indoor unit (B) and cooling operation in the second indoor unit (C).

The gas refrigerant that has flown out of the second indoor unit (C) passes through the gas pipe (GL), exchanges heat with cold water to condense in the heat exchanger (5) for cooling, and passes through the liquid return pipes (81, 79) to be recovered by the second main tank (T2). The liquid refrigerant condensed in the circulation cooler (72) is introduced into the second main tank (T2) through the branch pipe (76*b*).

Since the subordinate tank (ST) has been equalized in pressure to the heat absorbing element (71B) of the circulation heater (71), the liquid refrigerant within the subordinate tank (ST) passes through the liquid recovery pipe (74) to be supplied to the heat absorbing element (71B) of the circulation heater (71), as indicated by the broken arrows in FIG. 24. The supplied liquid refrigerant evaporates in the heat absorbing element (71B) to contribute to increased pressure in the first main tank (T1). Thereafter, the liquid refrigerant within the subordinate tank (ST) is mostly supplied to the heat absorbing element (71B) so that the pressure increasing electromagnetic valve (SV-P3) of the subordinate tank (ST) is closed, while the pressure reducing electromagnetic valve (SV-V3) of the subordinate tank (ST) is opened.

This lowers the pressure inside the subordinate tank (ST) and a part of the liquid refrigerant extruded from the first main tank (T1) passes through the auxiliary liquid pipe (80) and the liquid recovery pipe (74) to be recovered by the subordinate tank (ST), as indicated by the dash-dot arrows in FIG. 24. Such actions as extrusion and recovery of the liquid refrigerant in the subordinate tank (ST) are performed alternately irrespective of the actions performed in the respective electromagnetic valves (SV-P–SV-V2) of the main tanks (T1, T2).

After such actions are performed for a given period of time, the electromagnetic valves are switched. Specifically, the pressure increasing electromagnetic valve (SV-P1) of the first main tank (T1) and the pressure reducing electromagnetic valve (SV-V2) of the second main tank (T2) are closed. The pressure increasing electromagnetic valve (SV-P2) of the second main tank (T2) and the pressure reducing electromagnetic valve (SV-V1) of the first main tank (T1) are opened.

This lowers the pressure inside the first main tank (T1) and conversely increases the pressure inside the second main tank (T2). Accordingly, a refrigerant circulating state is achieved in which the liquid refrigerant extruded from the second main tank (T2) circulates as described above to be recovered by the first main tank (T1). In this case also, the opening and closing actions of the pressure increasing electromagnetic valve (SV-P3) and the pressure reducing electromagnetic valve (SV-V3) are repeated in the subordinate tank (ST), so that the actions of extrusion and recovery of the liquid refrigerant are alternately performed.

With the foregoing switching actions being repeatedly performed between the electromagnetic valves, the use-side refrigerant is circulated so that heating and cooling operations are performed in the first and second indoor units (B) and (C), respectively.

In the case where cooling operation is performed in the first indoor unit (B) and heating operation is performed in the second indoor unit (C), the first switching unit (D1) closes the high-pressure electromagnetic valve (55*a*) and opens the low-pressure electromagnetic valve (55*b*). On the other hand, the second switching unit (D2) opens the high-pressure electromagnetic valve (55*c*) and closes the low-pressure electromagnetic valve (55*d*). The driving power generating circuit (11) performs the same actions as in the case described above.

As a result, the liquid refrigerant extruded from one of the main tanks evaporates in the heat exchanger (3) for heating and condenses in the second indoor unit (C), thereby performing a heating action. The liquid refrigerant that has passed through the second indoor unit (C) is introduced into the first indoor unit (B) to evaporate, thereby performing a cooling action. The gas refrigerant that has passed through the first indoor unit (B) is condensed in the heat exchanger (5) for cooling to be recovered by the other of the main tanks. As for the other actions, they are the same as described above.

In the case of performing heating operation in each of the indoor units (B, C), the high-pressure electromagnetic valves (55*a*, 55*c*) of the switching units (D1, D2) are opened and the low-pressure electromagnetic valves (55*b*, 55*d*) thereof are closed. On the other hand, the electromagnetic valve (79*c*) of the liquid return pipe (79) is opened and the electromagnetic valve (78*a*) of the liquid extrusion pipe (78) is closed.

As a result, the use-side refrigerant extruded from one of the main tanks is evaporated in the heat exchanger (3) for heating and distributed to the individual indoor units (B, C). The refrigerant is condensed in the respective indoor heat exchangers (12, 14) of the indoor units (B, C) and passes through the liquid pipe (LL) and the liquid return pipe (79) to be recovered by the other of the main tanks.

In the case of performing cooling operation in each of the indoor units (B, C), the respective low-pressure electromagnetic valves (55*b*, 55*d*) of the switching units (D1, D2) are opened and the high-pressure electromagnetic valves (55*a*, 55*c*) thereof are closed. On the other hand, the electromagnetic valve (78*a*) of the liquid extrusion pipe (78) is opened and the electromagnetic valve (79*c*) of the liquid return pipe (79) is closed.

As a result, the use-side refrigerant extruded from one of the main tanks passes through the liquid extrusion pipe (78) and the liquid pipe (LL) and is separated into individual streams to the indoor units (B, C). The refrigerant is evaporated in the respective indoor heat exchangers (12, 14) of the indoor heat elements (B, C) and flows into the heat exchanger (5) for cooling through the low-pressure gas pipe (GL) to be condensed therein and recovered by the other of the main tanks through the liquid return pipe (79).

Thus, according to the present embodiment, the extrusion and recovery of the refrigerant from the main tanks (T1, T2) is performed by heating and cooling the use-side refrigerant by using the warm heat of the warm water and the cold heat of the cold water, each for local cooling and heating operations, whereby the driving force for circulating the refrigerant in the secondary refrigerant circuit (10) is obtained. This enables the refrigerant to perform a circulating action with higher efficiency and higher reliability than in a structure using a mechanical pump.

Embodiment 13

A description will be given to Embodiment 13 obtained by improving Embodiment 12 described above. The present embodiment also obtains a driving force for transferring the use-side refrigerant by utilizing a phase shift accompanying the heating and cooling of the refrigerant.

Figure 25:
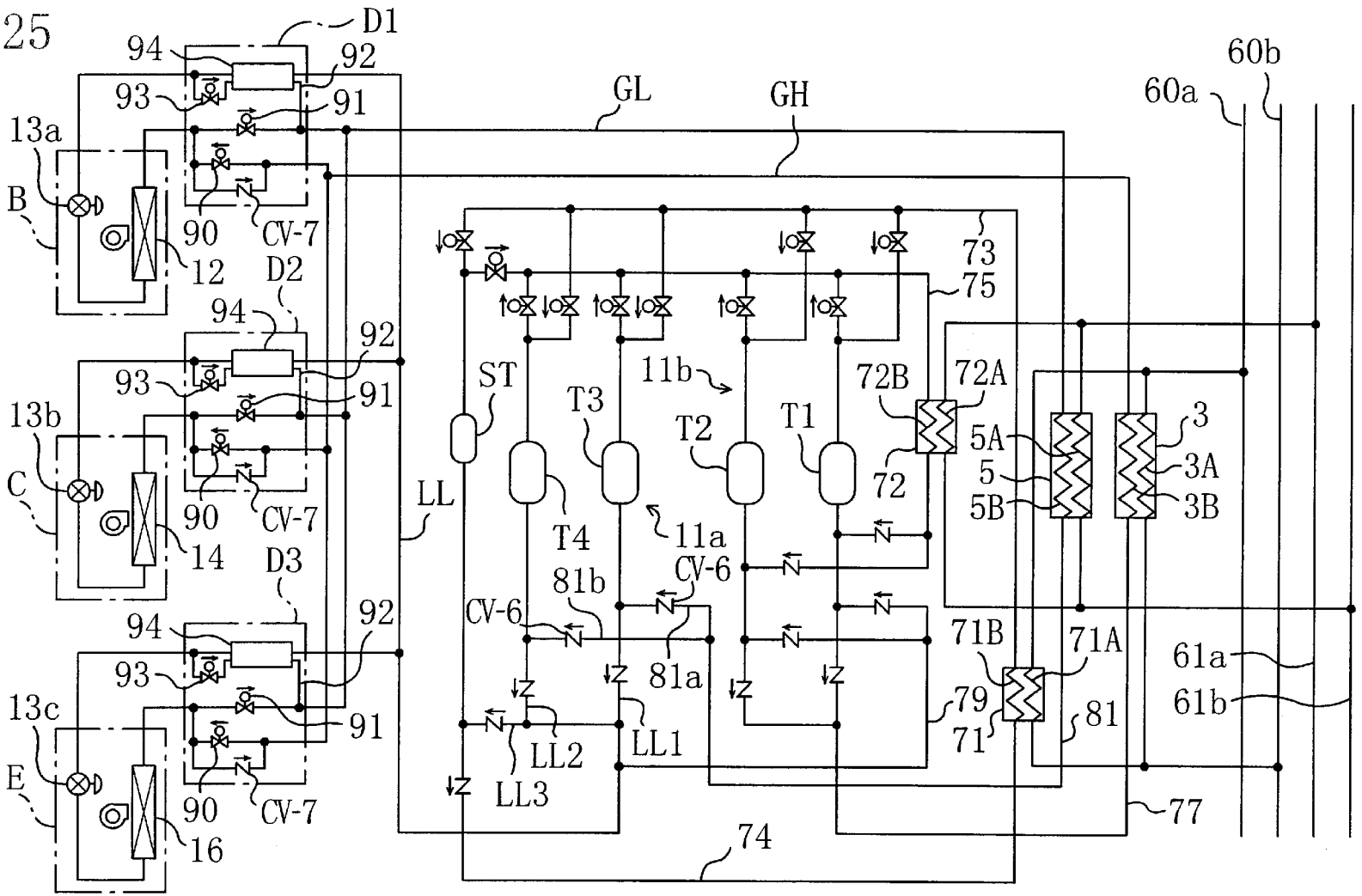
FIG. 25 is a refrigerant piping diagram of Embodiment 13.

Here, the description will be given only to portions different from Embodiment 12 and the description of the same components that are shown in FIG. 25 and used in Embodiment 12 will be omitted by retaining the same reference numerals. In the present embodiment, the present invention is applied to an air conditioner comprising three indoor units (B, C, E).

As shown in FIG. 25, a circuit according to the present embodiment comprises a pair of driving force generating circuits (11*a*, 11*b*). The downstream driving force generating circuit (11*b*) located on the righthand side of FIG. 25 has the first and second main tanks (T1, T2). On the other hand, the upstream driving force generating circuit (11*a*) located on the lefthand side of FIG. 25 has third and fourth main tanks (T3, T4) and the subordinate tank (ST). The downstream driving force generating circuit (11*b*) has generally the same structure as the driving force generating circuit according to Embodiment 12 described above.

On the other hand, the upstream driving force generating circuit (11*a*) has such a structure that the third and fourth main tanks (T3, T4) and the subordinate tank (ST) switchably communicate with the circulation heater (71) and with the circulation cooler (72). The switching mechanism is composed of a plurality of electromagnetic valves, similarly to the downstream driving force generating circuit (11*b*).

The downstream portion of the liquid return pipe (81) connected to the liquid side of the heat releasing element (5B) of the heat exchanger (5) for cooling is divided into branch pipes (81*a*, 81*b*) which are connected individually to the respective lower end portions of the third and fourth main tanks (T3, T4). Check valves (CV-6) for permitting only refrigerant flows directed to the third and fourth main tanks (T3, T4) are provided in the branch pipes (81*a*, 81*b*).

The downstream portion of the liquid pipe (LL) providing a connection between the respective liquid sides of the indoor units (B, C, E) is divided into three branch pipes (LL1, LL2, LL3) which are connected to the respective branch pipes (81*a*, 81*b*) of the liquid return pipe (81) and to the liquid recovery pipe (74), whereby the branch pipes (LL1, LL2, LL3) are connected individually to the respective lower ends of the third and fourth main tanks (T3, T4) and the subordinate tank (ST). The upstream portion of the liquid return pipe (79) is connected to the liquid pipe (LL).

Next, the switching units (D1, D2, D3) according to the present embodiment will be described.

Each of the switching units (D1, D2, D3) has the same structure. The high-pressure gas pipe (GH), the low-pressure gas pipe (GL), and the liquid pipe (LL) are introduced into the switching units (D1, D2, D3).

In each of the switching units (D1, D2, D3), the high-pressure gas pipe (GH) is divided into two branch pipes one of which has an electromagnetic pipe (90) and the other of which has a check valve (CV-7). The check valve (CV-7) permits only the flowing out of the refrigerant to the high-pressure gas pipe (GH).

The low-pressure gas pipe (GL) has an electromagnetic valve 91 in each of the switching units (D1, D2, D3). The low-pressure gas pipe (GL) and the high-pressure gas pipe (GH) are connected to each other in each of the switching units (D1, D2, D3) to be connected to the respective gas sides of the indoor heat exchangers (12, 14, 16).

The liquid pipe (LL) and the low-pressure gas pipe (GL) are connected to each other by a bypass pipe (92). The bypass pipe (92) has an electromagnetic valve (93). A heat exchanging part (94) for causing a heat exchange between the refrigerant flowing through the bypass pipe (92) and the refrigerant flowing through the low-pressure gas pipe (GL) is contained in each of the switching units (D1, D2, D3).

A description will be given next to operating actions in the present embodiment. The switching unit connecting to that one of the first to third indoor units (B, C, E) which performs heating operation opens the high-pressure electromagnetic valve (90) and closes the electromagnetic valve (93) of the bypass pipe (92) and the low-pressure electromagnetic valve (91).

On the other hand, the switching unit connecting to the indoor unit which performs cooling operation closes the high-pressure electromagnetic valve (90) and the electromagnetic valve (93) of the bypass pipe (92) and opens the low-pressure electromagnetic valve (91).

In this state, high pressure generated in the circulation heater (71) and low pressure generated in the circulation cooler (72) are caused to act on the respective tanks, similarly to Embodiment 12 described above. If high pressure is caused to act on the first and third tanks (T1) and (T3) and low pressure is caused to act on the second and fourth tanks (T2) and (T4), for example, the refrigerant circulates as indicated by the solid arrows in FIG. 26.

Figure 26:
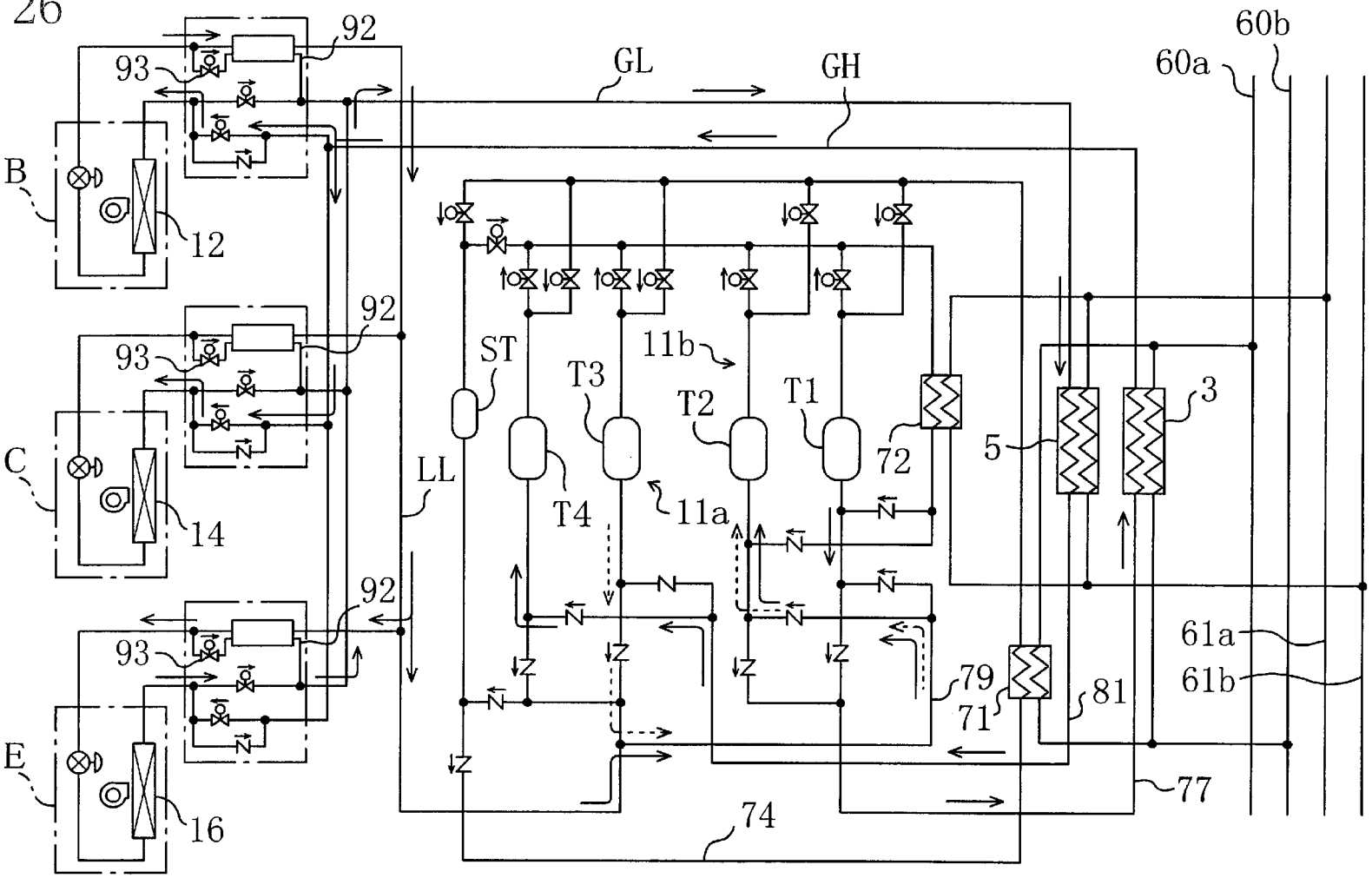
FIG. 26 is a view for illustrating the circulating operation of the refrigerant in Embodiment 13.

The refrigerant extruded from the first tank (T1) passes through the liquid pipe (77) to evaporate in the heat exchanger (3) for heating and flows into the indoor unit which performs heating operation through the high-pressure gas pipe (GH) (FIG. 26 illustrates the circulating operation of the refrigerant when heating operation is performed in the first and second indoor units (B, C) and cooling operation is performed in the third indoor unit (E)).

The refrigerant that has flown into the indoor units (B, C) is condensed in the indoor heat exchangers (12, 14) to perform indoor heating operation. Thereafter, the refrigerant passes through the liquid pipe (LL) and a part of the refrigerant flows into the indoor unit (E) which performs cooling operation. The refrigerant that has flown into the indoor unit (E) which performs cooling operation evaporates in the indoor heat exchanger (16) to perform indoor cooling operation, passes through the low-pressure gas pipe (GL) to condense in the heat exchanger (5) for cooling, passes through the liquid return pipe (81) to be recovered by the fourth main tank (T4). The remaining part of the refrigerant flows through the liquid pipe (LL) and passes through the liquid return pipe (79) to be recovered by the second main tank (T2).

On the other hand, the refrigerant extruded from the third main tank (T3) passes through the liquid return pipe (79) to be recovered by the second main tank T2, as indicated by the broken arrows in FIG. 26. In this case, the action of supplying and recovering the liquid refrigerant performed to and from the subordinate tank (ST) is such that a part of the refrigerant extruded from the third main tank (T3) is supplied when the low-pressure is maintained in the subordinate tank (ST) and the liquid refrigerant is recovered by the circulation heater (71) when high pressure is maintained in the subordinate tank (ST).

Such a circulating action of the refrigerant is performed with the downstream driving force generating circuit (11*b*) corresponding to the downstream pump according to Embodiment 6 described above and with the upstream driving force generating circuit (11*a*) corresponding to the upstream pump described above. Therefore, the circulating action of the use-side refrigerant can be performed properly in each of the heating rich state and the cooling rich state, similarly to Embodiment 6.

In the case where each of the indoor units (B, C, E) performs heating operation, the electromagnetic valve (93) of the bypass pipe (92) is opened. This allows the refrigerant condensed in the indoor heat exchangers (12, 14, 16) to be recovered through the bypass pipe (92) and the low-pressure gas pipe (GL).

Although each of the embodiments has described the case where the present invention is applied to an air conditioner, the present invention is also applicable to other refrigerating apparatus.

Although each of Embodiments 1 to 12 has described the case where the present invention is applied to an apparatus comprising two indoor units (B, C) and Embodiment 13 has described the case where the present invention is applied to an apparatus comprising three indoor units (B, C, E), the present invention is not limited thereto. The present invention is also applicable to an apparatus comprising three or more indoor units or to an apparatus in which a plurality of heat exchangers are contained in a single indoor unit.

INDUSTRIAL APPLICCAPABILITY

As described above, the refrigerating apparatus according to the present invention is suitable for use in an air conditioner comprising a plurality of indoor heat exchangers, especially in an air conditioner for simultaneously performing cooling and heating operations.

What is claimed is:

1. A refrigerating apparatus comprising: a heat-source-side unit (A); use-side units (B, C); and at least one of heat exchangers (12, 14) contained in each of the use-side units (B, C), heat generated in the heat-source-side unit (A) being supplied to the use-side units (B, C), at least one (12) of the heat exchangers forming a heat-release-side heat exchanger (12) for performing heat releasing operation, the other (14) of the heat exchangers forming a heat-absorption-side heat exchanger (14) for performing heat absorbing operation, the heat-source-side unit (A) including a heating element (3A), a cooling element (5A), a heat absorbing element (3B) for receiving warm heat from the heating element (3A), and a heat releasing element (SB) for receiving cold heat from the cooling element (5A), transfer means (11), the heat absorbing element (3B), the heat releasing element (5B), and the heat exchangers (12, 14) being connected to each other by a liquid pipe (LL) and gas pipes (GH, GL) to constitute a use-side refrigerant circuit (10) through which a refrigerant circulates, wherein, in the use-side refrigerant circuit (10), the liquid refrigerant is evaporated in the heat absorbing element (3B) with the warm heat from the heating element (3A), the gas refrigerant flows to the use-side units (B, C) via the gas pipe (GH) and releases heat in the heat-release-side heat exchanger (12) to be condensed, the liquid refrigerant absorbs heat in the heat-absorption-side heat exchanger (14) to be evaporated, the gas refrigerant flows to the heat-source-side unit (A) via the gas pipe (GL) to be condensed in the heat releasing element (5B) with the cold heat from the cooling element (5A), and then the liquid refrigerant flows into the heat absorbing element (3B).

2. The refrigerating apparatus according to claim 1, wherein a bypass path (20) is provided in the use-side refrigerant circuit (10) such that the condensed refrigerant in the heat-release-side heat exchanger (12) bypasses the heat-absorption-side heat exchanger (14) to flow into the heat releasing element (5B).

3. The refrigerating apparatus according to claim 2, wherein an adjusting mechanism (21) for adjusting a flow rate of the refrigerant bypassing the heat-absorption-side heat exchanger (14) is provided in the bypass path (20).

4. The refrigerating apparatus according to claim 3, wherein the adjusting mechanism (21) is a flow rate adjusting valve (21) the opening rate of which is adjustable, said refrigerating apparatus further comprising opening rate adjusting means for increasing the opening rate of the flow rate adjusting valve (21) as a required amount of heat to be absorbed by the heat-absorption-side heat exchanger (14) is smaller than a required amount of heat to be released from the heat-release-side heat exchanger (12).

5. The refrigerating apparatus according to claim 1, wherein a bypass path (25) is provided in the use-side refrigerating circuit (10) such that the condensed refrigerant in the heat releasing element (5B) bypasses the heat absorbing element (3B) and flows into the heat-release-side heat exchanger (12).

6. The refrigerating apparatus according to claim 5, wherein an adjusting mechanism (26) for adjusting a flow rate of the refrigerant bypassing the heat absorbing element (3B) is provided in the bypass path (25).

7. The refrigerating apparatus according to claim 6, wherein the adjusting mechanism (26) is a flow rate adjusting valve (26) the opening rate of which is adjustable, the apparatus further comprising opening rate adjusting means for increasing the opening rate of the flow rate adjusting valve (26) as a required amount of heat to be released from the heat-release-side heat exchanger (12) is smaller than a required amount of heat to be absorbed by the heat-absorption-side heat exchanger (14).

8. The refrigerating apparatus according to claim 1, wherein liquid passage pipes (30, 35, 40) are connected between a first liquid pipe (LL) providing a connection between the heat releasing element (5B) and the heat absorbing element (3B) and a second liquid pipe (LL) providing a connection between the heat-release-side heat exchanger (12) and the heat-absorption-side heat exchanger (14), the liquid passage pipes (30, 35, 40) allowing the refrigerant to flow between the first pipe (LL) and the second pipe (LL).

9. The refrigerating apparatus according to claim 8, wherein the transfer means (11) is provided in the first liquid pipe (LL) and the liquid passage pipe (30) has an upstream end connected to the second liquid pipe (LL) and a downstream end connected between the transfer means (11) and the heat releasing element (5B) in the first liquid pipe (LL).

10. The refrigerating apparatus according to claim 9, wherein a flow rate adjusting valve (31) the flow rate of which is adjustable is provided in the liquid passage pipe (30), the apparatus further comprising opening rate adjusting means for increasing an amount of refrigerant flowing through the liquid passage pipe (30) by increasing the opening rate of the flow rate adjusting valve (31) as a required amount of heat to be absorbed by the heat-absorption-side heat exchanger (14) is smaller than a required amount of heat to be released from the heat-release-side heat exchanger (12).

11. The refrigerating apparatus according to claim 8, wherein the transfer means (11) is provided in the first liquid pipe (LL) and the liquid passage pipe (35) has an upstream end connected between the transfer means (11) and the heat releasing element (5B) in the first liquid pipe (LL) and a downstream end connected to the second liquid pipe (LL).

12. The refrigerating apparatus according to claim 11, wherein a flow rate adjusting valve (36) the opening rate of which is adjustable is provided in the liquid passage pipe (35), the apparatus further comprising opening rate adjusting means for increasing an amount of refrigerant flowing through the liquid passage pipe (35) by increasing the opening rate of the flow rate adjusting valve (36) as a required amount of heat to be released from the heat-release-side heat exchanger (12) is smaller than a required amount of heat to be absorbed by the heat-absorption-side heat exchanger (14).

13. The refrigerating apparatus according to claim 8, wherein two transfer means (11*a*, 11*b*) are disposed in the first liquid pipe (LL) and a liquid passage pipe (40) is connected between the two transfer means (11*a*, 11*b*) in the first liquid pipe (LL).

14. The refrigerating apparatus according to claim 13, further comprising capability adjusting means for adjusting the transfer capability of the downstream transfer means (11*b*) to be higher than the transfer capability of the upstream transfer means (11*a*) as a required amount of heat to be absorbed by the heat-absorption-side heat exchanger (14) is smaller than a required amount of heat to be released from the heat-release-side heat exchanger (12), while adjusting the transfer capability of the upstream transfer means (11*a*) to be higher than the transfer capability of the downstream transfer means (11*b*) as a required amount of heat to be released from the heat-release-side heat exchanger (12) is smaller than a required amount of heat to be absorbed by the heat-absorption-side heat exchanger (14).

15. The refrigerating apparatus according to claim 8, wherein the transfer means (11) is provided in the first liquid pipe (LL) and the portion of the liquid passage pipe (40) connected to the first liquid pipe (LL) is divided into a first branch pipe (40*a*) and a second branch pipe (40*b*), said first branch pipe (40*a*) being connected between the heat releasing element (5B) and the transfer means (11) in the first liquid pipe (LL), said second branch pipe (40*b*) being connected between the transfer means (11) and the heat absorbing element (3B) in the first liquid pipe (LL), a first flow rate control valve (41*a*) and a second flow rate control valve (40*b*) being provided in the first branch pipe (40*a*) and in the second branch pipe (40*b*), respectively.

16. The refrigerating apparatus according to claim 15, further comprising open/close control means for opening the first flow rate control valve (41*a*) and closing the second flow rate control valve (41*b*) when a required amount of heat to be absorbed by the heat-absorption-side heat exchanger (14) is smaller than a required amount of heat to be released from the heat-release-side heat exchanger (12), while opening the second flow rate control valve (41*b*) and closing the first flow rate control valve (41*a*) when a required amount of heat to be released from the heat-release-side heat exchanger (12) is smaller than a required amount of heat to be absorbed by the heat-absorption-side heat exchanger (14).

17. The refrigerating apparatus according to claim 8, wherein the transfer means (11) is provided in the first liquid pipe (LL) and the portion of the liquid passage pipe (40) connected to the first liquid pipe (LL) is divided into a first branch pipe (40*a*) and a second branch pipe (40*b*), said first branch pipe (40*a*) being connected to the gas pipe (GL) upstream of the heat releasing element (5B), said second branch pipe (40*b*) being connected between the transfer means (11) and the heat absorbing element (3B) in the first liquid pipe (LL), a first flow rate control valve (42*a*) and a second flow rate control valve (42*b*) being provided in the first branch pipe (40*a*) and in the second branch pipe (40*b*).

18. The refrigerating apparatus according to claim 17, further comprising opening rate adjusting means for adjusting respective opening rates of the flow rate control valves (42*a*, 42*b*) such that the opening rate of the first flow rate control valve (42*a*) is higher than the opening rate of the second flow rate control valve (42*b*) as a required amount of heat to be absorbed by the heat-absorption-side heat exchanger (14) is smaller than a required amount of heat to be released from the heat-release-side heat exchanger (12) and that the opening rate of the second flow rate control valve (42*b*) is higher than the opening rate of the first flow rate control valve (42*a*) as a required amount of heat to be released from the heat-release-side heat exchanger (12) is smaller than a required amount of heat to be absorbed by the heat-absorption-side heat exchanger (14).

19. The refrigerating apparatus according to claim 1, further comprising a plurality of heat-source-side units (A1, A2), respective gas sides of the heat absorbing elements (3B) of the individual heat-source-side units (A1, A2) being connected to each other and to the heat-release-side heat exchanger (12) via the gas pipe (GH), respective gas sides of the heat releasing elements (5B) of the individual heat-source-side units (A1, A2) being connected to each other and to the heat-absorption-side heat exchanger (14) via the gas pipe (GL).

20. The refrigerating apparatus according to claim 13, further comprising an auxiliary heat-source-side unit (A2), the auxiliary heat-source-side unit (A2) being switchable between a heat-release assisting action of supplying the gas refrigerant to the heat-release-side heat exchanger (12) and recovering the liquid refrigerant flowing out of the heat-release-side heat exchanger (12) without allowing the refrigerant to pass through the heat-absorption-side heat exchanger (14) and a heat-absorption assisting action of supplying the liquid refrigerant to the heat-absorption-side heat exchanger (14) without allowing the refrigerant to pass through the heat-release-side heat exchanger (12) and recovering the gas refrigerant flowing out of the heat-absorption-side heat exchanger (14).

21. The refrigerating apparatus according to claim 20, wherein the auxiliary heat-source-side unit (A2) has transfer means (50), a heat exchanger (52), and flow-path switching means (51), the heat-release assisting action of the auxiliary heat-source-side unit (A2) includes switching the flow-path switching means (51), supplying the gas refrigerant ejected from the transfer means (50) and evaporated in the heat exchanger (52) to the heat-release-side heat exchanger (12), and recovering, in the transfer means (50), the liquid refrigerant condensed in the heat-release-side heat exchanger (12), and the heat-absorption assisting action of the auxiliary heat-source-side unit (A2) includes switching the flow-path switching means (51), supplying the liquid refrigerant ejected from the transfer means (50) to the heat-absorption-side heat exchanger (14), and condensing, in the heat exchanger (52), the gas refrigerant passing through the heat-absorption-side heat exchanger (14) and circulating through the use-side refrigerant circuit (10) such that the refrigerant is recovered by the transfer means (50).

22. The refrigerating apparatus according to claim 21, further comprising switch control means for switching the flow rate switching means (51) such that the heat-release assisting action is performed when a required amount of heat to be released from the heat-release-side heat exchanger (12) is larger than a required amount of heat to be absorbed by the heat-absorption-side heat exchanger (14) and the heat-absorption assisting action is performed when the required amount of heat to be absorbed by the heat-absorption-side heat exchanger (14) is larger than a required amount of heat to be released from the heat-release-side heat exchanger (12).

23. The refrigerating apparatus according to claim 1, wherein switching means (D1, D2) for selectively switching the respective gas sides of the heat exchangers (12, 14) between the heat absorbing element (3B) and the heat releasing element (5B) to provide connections between the respective gas sides and the selected ones of the elements are provided in the use-side refrigerant circuit (10).

24. The refrigerating apparatus according to claim 23, wherein first switching valves (55*a*, 55*c*) for switching the respective gas sides of the heat exchangers (12, 14) and the heat absorbing element (3B) between a communicating state and an interrupted state and second switching valves (55*b*, 55*d*) for switching the respective gas sides of the heat exchangers (12, 14) and the heat releasing element (5B) between the communicating state and the interrupted state are provided in the switching means (D1, D2), the refrigerating apparatus further comprising switch control means for controlling the switching means (D1, D2) such that the heat exchangers (12, 14) connected to the switching means (D1, D2) being formed into heat-release-side heat exchangers (12, 14) by opening the first switching valves (55*a*, 55*c*) and closing the second switching valves (55*b*, 55*d*) in one of the switching means (D1, D2) and that the heat exchangers (12, 14) connected to the other of the switching means (D1, D2) being formed into heat-absorption-side heat exchangers (12, 14) by closing the first switching valves (55*a*, 55*c*) and opening the second switching valves (55*b*, 55*d*) in the other of the switching means (D1, D2).

25. The refrigerating apparatus according to claim 1, wherein the transfer means (11) is a mechanical pump.

26. The refrigerating apparatus according to claim 1, wherein the transfer means (11) has at least one of pressure increasing means (71) for heating the liquid refrigerant and generating a high pressure and pressure reducing means (72) for cooling the gas refrigerant and generating a low pressure and generates a driving force for circulating the refrigerant in the use-side refrigerant circuit (10) with the pressure generated by the pressure increasing means (71) or by the pressure reducing means (72).

* * * * *